US007699428B2

(12) United States Patent
Kato

(10) Patent No.: US 7,699,428 B2
(45) Date of Patent: Apr. 20, 2010

(54) DISCHARGE AMOUNT MEASUREMENT METHOD, PATTERN FORMATION METHOD, DEVICE, ELECTRO-OPTICAL DEVICE, AND ELECTRONIC INSTRUMENT

(75) Inventor: Tsuyoshi Kato, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 585 days.

(21) Appl. No.: 11/594,100

(22) Filed: Nov. 8, 2006

(65) Prior Publication Data

US 2007/0109342 A1 May 17, 2007

(30) Foreign Application Priority Data

Nov. 11, 2005 (JP) ..... 2005-327923
Sep. 19, 2006 (JP) ..... 2006-252482

(51) Int. Cl.
*B41J 29/393* (2006.01)

(52) U.S. Cl. ..... 347/19; 347/14

(58) Field of Classification Search ..... 347/19
See application file for complete search history.

(56) References Cited

U.S. PATENT DOCUMENTS 6,655,775 B1 * 12/2003 Raman et al. ..... 347/19
6,863,097 B2 3/2005 Ryu et al.
7,121,642 B2 * 10/2006 Stoessel et al. ..... 347/19
2004/0023567 A1 * 2/2004 Koyama et al. ..... 439/894

FOREIGN PATENT DOCUMENTS

JP 2004-209429 A 7/2004
KR 10-0488535 B1 5/2005

* cited by examiner

*Primary Examiner*—Matthew Luu
*Assistant Examiner*—Brian J Goldberg
(74) *Attorney, Agent, or Firm*—Global IP Counselors, LLP

(57) ABSTRACT

A discharge amount measurement method is configured to measure a discharge amount of a liquid discharged from at least one nozzle of a droplet discharge head. The discharge amount measurement method includes discharging the liquid as a droplet from the at least one nozzle of the droplet discharge head by a number of discharges that is set to obtain a measurable quantity by driving the droplet discharge head based on measurement discharge data that is substantially identical to data used when a drawing pattern is formed by discharging the liquid from the at least one nozzle of the droplet discharge head, measuring the discharge amount of the liquid discharged from the at least one nozzle of the droplet discharge head, and calculating an average discharge amount based on the discharge amount and the number of discharges.

7 Claims, 14 Drawing Sheets

Fig. 14

(a)

FIRST BITMAP

| Nozzle | 1 | 2 | 3 | 4 | 5 | 6 | 7 | 8 | 9 | 10 |
|---|---|---|---|---|---|---|---|---|---|---|
| #11 | 1 | 1 | 1 | 1 | 0 | 0 | 0 | 0 | 0 | 0 |
| #12 | 1 | 1 | 1 | 1 | 0 | 0 | 0 | 0 | 0 | 0 |
| #13 | 0 | 0 | 0 | 0 | 0 | 0 | 0 | 0 | 0 | 0 |
| #14 | 1 | 1 | 1 | 1 | 0 | 0 | 0 | 0 | 0 | 0 |
| #15 | 1 | 1 | 1 | 1 | 0 | 0 | 0 | 0 | 0 | 0 |
| #16 | 0 | 0 | 0 | 0 | 0 | 0 | 0 | 0 | 0 | 0 |
| #17 | 1 | 1 | 1 | 1 | 0 | 0 | 0 | 0 | 0 | 0 |
| #18 | 1 | 1 | 1 | 1 | 0 | 0 | 0 | 0 | 0 | 0 |
| #19 | 0 | 0 | 0 | 0 | 0 | 0 | 0 | 0 | 0 | 0 |
| #20 | 1 | 1 | 1 | 1 | 0 | 0 | 0 | 0 | 0 | 0 |
| #161 | 1 | 1 | 1 | 1 | 0 | 0 | 0 | 0 | 0 | 0 |
| #162 | 0 | 0 | 0 | 0 | 0 | 0 | 0 | 0 | 0 | 0 |
| #163 | 1 | 1 | 1 | 1 | 0 | 0 | 0 | 0 | 0 | 0 |
| #164 | 1 | 1 | 1 | 1 | 0 | 0 | 0 | 0 | 0 | 0 |
| #165 | 0 | 0 | 0 | 0 | 0 | 0 | 0 | 0 | 0 | 0 |
| #166 | 1 | 1 | 1 | 1 | 0 | 0 | 0 | 0 | 0 | 0 |
| #167 | 1 | 1 | 1 | 1 | 0 | 0 | 0 | 0 | 0 | 0 |
| #168 | 0 | 0 | 0 | 0 | 0 | 0 | 0 | 0 | 0 | 0 |
| #169 | 1 | 1 | 1 | 1 | 0 | 0 | 0 | 0 | 0 | 0 |
| #170 | 1 | 1 | 1 | 1 | 0 | 0 | 0 | 0 | 0 | 0 |
| | 1 | 2 | 3 | 4 | 5 | 6 | 7 | 8 | 9 | 10 |

SELECTIVE NOZZLE DISCHARGE — ALL-NOZZLE NON-DISCHARGE

SECOND BITMAP

| 1 | 2 | 3 | 4 | 5 | 6 | 7 | 8 | 9 | 10 |
|---|---|---|---|---|---|---|---|---|---|
| 0 | 0 | 0 | 0 | 0 | 0 | 0 | 0 | 0 | 0 |
| 1 | 1 | 1 | 1 | 0 | 0 | 0 | 0 | 0 | 0 |
| 1 | 1 | 1 | 1 | 0 | 0 | 0 | 0 | 0 | 0 |
| 0 | 0 | 0 | 0 | 0 | 0 | 0 | 0 | 0 | 0 |
| 1 | 1 | 1 | 1 | 0 | 0 | 0 | 0 | 0 | 0 |
| 1 | 1 | 1 | 1 | 0 | 0 | 0 | 0 | 0 | 0 |
| 0 | 0 | 0 | 0 | 0 | 0 | 0 | 0 | 0 | 0 |
| 1 | 1 | 1 | 1 | 0 | 0 | 0 | 0 | 0 | 0 |
| 1 | 1 | 1 | 1 | 0 | 0 | 0 | 0 | 0 | 0 |
| 0 | 0 | 0 | 0 | 0 | 0 | 0 | 0 | 0 | 0 |
| 0 | 0 | 0 | 0 | 0 | 0 | 0 | 0 | 0 | 0 |
| 1 | 1 | 1 | 1 | 0 | 0 | 0 | 0 | 0 | 0 |
| 1 | 1 | 1 | 1 | 0 | 0 | 0 | 0 | 0 | 0 |
| 0 | 0 | 0 | 0 | 0 | 0 | 0 | 0 | 0 | 0 |
| 1 | 1 | 1 | 1 | 0 | 0 | 0 | 0 | 0 | 0 |
| 1 | 1 | 1 | 1 | 0 | 0 | 0 | 0 | 0 | 0 |
| 0 | 0 | 0 | 0 | 0 | 0 | 0 | 0 | 0 | 0 |
| 1 | 1 | 1 | 1 | 0 | 0 | 0 | 0 | 0 | 0 |
| 1 | 1 | 1 | 1 | 0 | 0 | 0 | 0 | 0 | 0 |
| 0 | 0 | 0 | 0 | 0 | 0 | 0 | 0 | 0 | 0 |
| 1 | 2 | 3 | 4 | 5 | 6 | 7 | 8 | 9 | 10 |

SELECTIVE NOZZLE DISCHARGE — ALL-NOZZLE NON-DISCHARGE (b)

THIRD BITMAP

| Nozzle | 1 | 2 | 3 | 4 | 5 | 6 | 7 | 8 | 9 | 10 |
|---|---|---|---|---|---|---|---|---|---|---|
| #11 | 1 | 1 | 1 | 0 | 0 | 0 | 0 | 0 | 0 | 0 |
| #12 | 0 | 0 | 0 | 0 | 0 | 0 | 0 | 0 | 0 | 0 |
| #13 | 1 | 1 | 1 | 0 | 0 | 0 | 0 | 0 | 0 | 0 |
| #14 | 1 | 1 | 1 | 0 | 0 | 0 | 0 | 0 | 0 | 0 |
| #15 | 0 | 0 | 0 | 0 | 0 | 0 | 0 | 0 | 0 | 0 |
| #16 | 1 | 1 | 1 | 0 | 0 | 0 | 0 | 0 | 0 | 0 |
| #17 | 1 | 1 | 1 | 0 | 0 | 0 | 0 | 0 | 0 | 0 |
| #18 | 0 | 0 | 0 | 0 | 0 | 0 | 0 | 0 | 0 | 0 |
| #19 | 1 | 1 | 1 | 0 | 0 | 0 | 0 | 0 | 0 | 0 |
| #20 | 1 | 1 | 1 | 0 | 0 | 0 | 0 | 0 | 0 | 0 |
| #161 | 1 | 1 | 1 | 0 | 0 | 0 | 0 | 0 | 0 | 0 |
| #162 | 0 | 0 | 0 | 0 | 0 | 0 | 0 | 0 | 0 | 0 |
| #163 | 1 | 1 | 1 | 0 | 0 | 0 | 0 | 0 | 0 | 0 |
| #164 | 1 | 1 | 1 | 0 | 0 | 0 | 0 | 0 | 0 | 0 |
| #165 | 0 | 0 | 0 | 0 | 0 | 0 | 0 | 0 | 0 | 0 |
| #166 | 1 | 1 | 1 | 0 | 0 | 0 | 0 | 0 | 0 | 0 |
| #167 | 1 | 1 | 1 | 0 | 0 | 0 | 0 | 0 | 0 | 0 |
| #168 | 0 | 0 | 0 | 0 | 0 | 0 | 0 | 0 | 0 | 0 |
| #169 | 1 | 1 | 1 | 0 | 0 | 0 | 0 | 0 | 0 | 0 |
| #170 | 1 | 1 | 1 | 0 | 0 | 0 | 0 | 0 | 0 | 0 |
| | 1 | 2 | 3 | 4 | 5 | 6 | 7 | 8 | 9 | 10 |

SELECTIVE NOZZLE DISCHARGE — ALL-NOZZLE NON-DISCHARGE

FORTH BITMAP

| 1 | 2 | 3 | 4 | 5 | 6 | 7 | 8 | 9 | 10 |
|---|---|---|---|---|---|---|---|---|---|
| 1 | 1 | 1 | 0 | 0 | 0 | 0 | 0 | 0 | 0 |
| 1 | 1 | 1 | 0 | 0 | 0 | 0 | 0 | 0 | 0 |
| 0 | 0 | 0 | 0 | 0 | 0 | 0 | 0 | 0 | 0 |
| 1 | 1 | 1 | 0 | 0 | 0 | 0 | 0 | 0 | 0 |
| 1 | 1 | 1 | 0 | 0 | 0 | 0 | 0 | 0 | 0 |
| 0 | 0 | 0 | 0 | 0 | 0 | 0 | 0 | 0 | 0 |
| 1 | 1 | 1 | 0 | 0 | 0 | 0 | 0 | 0 | 0 |
| 1 | 1 | 1 | 0 | 0 | 0 | 0 | 0 | 0 | 0 |
| 0 | 0 | 0 | 0 | 0 | 0 | 0 | 0 | 0 | 0 |
| 1 | 1 | 1 | 0 | 0 | 0 | 0 | 0 | 0 | 0 |
| 0 | 0 | 0 | 0 | 0 | 0 | 0 | 0 | 0 | 0 |
| 1 | 1 | 1 | 0 | 0 | 0 | 0 | 0 | 0 | 0 |
| 1 | 1 | 1 | 0 | 0 | 0 | 0 | 0 | 0 | 0 |
| 0 | 0 | 0 | 0 | 0 | 0 | 0 | 0 | 0 | 0 |
| 1 | 1 | 1 | 0 | 0 | 0 | 0 | 0 | 0 | 0 |
| 1 | 1 | 1 | 0 | 0 | 0 | 0 | 0 | 0 | 0 |
| 0 | 0 | 0 | 0 | 0 | 0 | 0 | 0 | 0 | 0 |
| 1 | 1 | 1 | 0 | 0 | 0 | 0 | 0 | 0 | 0 |
| 1 | 1 | 1 | 0 | 0 | 0 | 0 | 0 | 0 | 0 |
| 0 | 0 | 0 | 0 | 0 | 0 | 0 | 0 | 0 | 0 |
| 1 | 2 | 3 | 4 | 5 | 6 | 7 | 8 | 9 | 10 |

SELECTIVE NOZZLE DISCHARGE — ALL-NOZZLE NON-DISCHARGE

DISCHARGE AMOUNT MEASUREMENT METHOD, PATTERN FORMATION METHOD, DEVICE, ELECTRO-OPTICAL DEVICE, AND ELECTRONIC INSTRUMENT

CROSS-REFERENCE TO RELATED APPLICATIONS

This application claims priority to Japanese Patent Application Nos. 2005-327923 filed on Nov. 11, 2005 and 2006-252482 filed on Sep. 19, 2006. The entire disclosures of Japanese Patent Application Nos. 2005-327923 and 2006-252482 are hereby incorporated herein by reference.

BACKGROUND OF THE INVENTION

1. Field of the Invention

The present invention relates to a discharge amount measurement method, to a pattern formation method, to a device, to an electro-optical device, and to an electronic instrument in a droplet discharge method.

2. Background Information

A method has been proposed for forming a color filter in a liquid crystal display device or a light-emitting layer in an organic EL display device, for example, by utilizing an inkjet system (droplet discharge method) that is used in an inkjet printer.

In this type of droplet discharge method, the quantity of droplets discharged from the droplet discharge head must be adjusted to the proper value. For example, when the quantity of discharged droplets that include a colorant material is inappropriate in a method for forming a color filter, the light that passes through the color filter is excessively or inadequately colored, and a color filter is obtained that has inconsistent quality and significant variation in color.

Japanese Laid-Open Patent Application No. 2004-209429 describes a method for obtaining the proper discharge amount of droplets. More specifically, this reference describes correcting the actual discharge amount of droplets by making the environment in which the discharge amount of droplets is measured the same as the environment when droplets are discharged onto a workpiece in order to reduce the effects of temperature or humidity.

However, the above mentioned reference does not describe the pattern and discharge timing at which droplets are discharged onto the workpiece. The discharge amount or discharge rate is usually measured during continuous discharge of droplets from a plurality of nozzles of a droplet discharge head. The discharge amount of droplets measured by this method sometimes differs from the rate at which droplets are discharged when a plurality of nozzles are selected for droplet discharge in order to actually form a drawing pattern. Specifically, it is difficult to minimize fluctuations in the droplet discharge amount that are caused by the drawing pattern in which droplets are discharged onto the workpiece.

In view of the above, it will be apparent to those skilled in the art from this disclosure that there exists a need for an improved discharge amount measurement method. This invention addresses this need in the art as well as other needs, which will become apparent to those skilled in the art from this disclosure.

SUMMARY OF THE INVENTION

The present invention was conceived in view of the aforementioned drawbacks, and one object thereof is to provide a method for measuring the discharge amount of droplets in a state that approaches the conditions that exist when a drawing pattern is formed, and to provide a pattern formation method, a device, an electro-optical device, and an electronic instrument that use the discharge amount measurement method.

The discharge amount measurement method in accordance with one aspect of the present invention measures the discharge amount or discharge amount of a liquid discharged from a nozzle of a droplet discharge head; and the discharge amount measurement method is characterized in comprising a measurement discharge step for driving the droplet discharge head on the basis of measurement discharge data, setting a number of discharges so as to obtain a measurable quantity, and discharging the liquid from the nozzle as droplets; a measurement step for measuring the discharge amount of the discharged liquid; and a calculation step for computing an average discharge amount from the measured discharge amount and the measured number of discharges; wherein the discharge data used as the measurement discharge data are substantially the same as the data used when a drawing pattern is formed by discharge.

The quantity of droplets discharged when droplets are continuously discharged from the nozzles of the droplet discharge head is not the same as when the droplets are discharged intermittently. The reason for this is considered to be a change in the state of impedance between the droplet discharge head and the driving device that drives the droplet discharge head. Another reason is considered to be that the resistance of the fluid in the flow channel from the tank that stores the discharge fluid to the droplet discharge head varies according to the number of droplet discharge heads in operation. In the measurement discharge step according to this method, the measurement discharge data used to discharge the liquid is substantially the same as the data used when a drawing pattern is formed by discharge. Compared to a case in which droplets are simply discharged continuously from the nozzles, a droplet discharge amount can be obtained that approaches the discharge amount used when a drawing pattern is actually formed by discharge.

In accordance with another aspect of the present invention, a weight is measured as the discharge amount of the discharged liquid in the measurement step. The quantity of the discharged liquid is thereby measured according to the weight thereof. The discharged droplets tend not to assume a consistent shape after landing on the workpiece, and the discharge amount of the liquid can be measured more easily than by a volume measurement. Devices for converting the value of a measured weight into an electric current are also widely used, and the discharge amount can be measured with good precision by converting the weight into an electric current and measuring the quantity of electric current.

A configuration may also be adopted in which the aforementioned droplet discharge head comprises a plurality of nozzles, a liquid is discharged from the plurality of nozzles in the measurement discharge step, and the discharge amount of the liquid discharged from the plurality of nozzles of the droplet discharge head is measured in the measurement step. In this configuration, droplets are discharged from a plurality of nozzles, and the discharge amount of the droplets is measured using a plurality of nozzles at once. The number of measurements taken can therefore be reduced in comparison to a case in which the quantity of droplets discharged is measured for each nozzle individually.

It is also preferred that the measurement discharge data comprise all-nozzle non-discharge information in which none of the nozzles discharge the liquid, and that the measurement discharge data be used in a state in which a portion of the continuous all-nozzle non-discharge information is deleted when the all-nozzle non-discharge information is continuous. Since the measurement discharge data are used in a state in which a portion of the continuous all-nozzle non-discharge information is deleted, the amount of time needed to discharge droplets for measurement can be reduced.

It is also preferred that the measurement discharge data comprise first measurement discharge data that have information about continuously non-discharging nozzles among the plurality of nozzles, and second measurement discharge data that have information about nozzles that change from non-discharging nozzles to nozzles that continuously discharge liquid; and that the droplet discharge head be driven using at least the first measurement discharge data and the second measurement discharge data, the number of discharges be set so as to obtain a measurable quantity, and the liquid be discharged as droplets in the measurement discharge step.

When a liquid is discharged from a plurality of nozzles to form a drawing pattern, the number or distribution of nozzles that are used simultaneously varies, and this variation also affects the discharge amount of the discharged droplets. According to this method, measurement discharge data are used that include first measurement discharge data that have information about continuously non-discharging nozzles among the plurality of nozzles, and second measurement discharge data that have information about nozzles that change from non-discharging nozzles to nozzles that continuously discharge liquid. As a result, droplets are discharged by a prescribed number of discharges from all of the nozzles, and the discharge amount can be more accurately calculated.

In accordance with another aspect of the present invention, the droplet discharge head comprises at least two nozzle rows that are composed of a plurality of nozzles, and the droplet discharge head is driven using the first measurement discharge data and the second measurement discharge data for each of the at least two nozzle rows in the measurement discharge step. The droplet discharge head is thereby driven using first measurement discharge data and second measurement discharge data for each nozzle row even when the droplet discharge head has so-called multiple nozzle rows. An accurate droplet discharge amount can therefore be calculated for each nozzle row.

The pattern formation method in accordance with another aspect of the present invention is used to form a drawing pattern composed of a functional material on a workpiece, and the pattern formation method is characterized in comprising a discharge amount estimation step for using the discharge amount measurement method according to the aforementioned aspects of the present invention to estimate the average discharge amount of a functional fluid that includes the functional material discharged from a droplet discharge head, a determination step for making a determination based on the estimated result as to whether to adjust the discharge amount of the functional fluid that is discharged from the droplet discharge head, an adjustment step for changing drive conditions of the droplet discharge head to adjust the discharge amount when an adjustment is necessary, a drawing step for discharging and applying the functional fluid as droplets from a nozzle of the droplet discharge head in synchrony with main scanning whereby the workpiece and the droplet discharge head are moved relative to each other, and a pattern formation step for fixing the discharged functional fluid to form the drawing pattern.

According to this method, a determination is made in the determination step based on the estimated result as to whether to adjust the discharge amount of the functional fluid that is discharged from the droplet discharge head. When adjustment is needed, the drive conditions of the droplet discharge head are changed in the adjustment step to adjust the discharge amount. Accordingly, a drawing pattern that has little variation in film thickness caused by fluctuation of the droplet discharge amount can be formed on a workpiece by discharging and applying the functional fluid in the drawing step in a state in which the droplet discharge amount is optimized, and fixing the functional fluid thus discharged and applied.

It is preferred that the functional fluid be discharged into a pattern using a plurality of droplet discharge heads in the drawing step, that the functional fluid be discharged for each of the plurality of droplet discharge heads in the measurement discharge step, that the discharge amount of the functional fluid discharged for each of the plurality of droplet discharge heads be measured in the measurement step, and that adjustment be performed in the adjustment step so that a difference in the average discharge amount among the plurality of droplet discharge heads is reduced. It is thereby possible to form a drawing pattern that has little variation in thickness due to a difference in the average discharge amount among the plurality of droplet discharge heads.

It is also preferred that the functional fluid be discharged from the droplet discharge heads in the measurement discharge step on the basis of the measurement discharge data generated from positioning data for positioning droplets on the workpiece and information about the positions of the workpiece and the droplet discharge heads relative to each other when the main scanning is performed in the drawing step. The measurement discharge data are thereby generated from positioning data for positioning droplets on the workpiece, and information about the positions of the workpiece and the droplet discharge heads relative to each other when main scanning is performed in the drawing step. Accordingly, measurement discharge is performed at substantially the same timing with respect to actual drawing by discharge in the drawing step. Specifically, the discharge amount of droplets can be adjusted in advance to approximate the state that occurs when a drawing pattern is formed by discharge.

It is also preferred that the droplet discharge head comprise a plurality of nozzles, that main scanning for moving the workpiece and the droplet discharge head relative to each other be performed a plurality of times, and sub-scanning be performed for moving the plurality of droplet discharge heads in a direction orthogonal to the direction of the main scanning during the plurality of principal scans in the drawing step, and that the measurement discharge data be used in the measurement discharge step, the data including third measurement discharge data wherein nozzle information in which nozzles considered to be continuously non-discharging among the plurality of nozzles in the first measurement discharge data is changed in conjunction with sub-scanning, and fourth measurement discharge data that have nozzle information in which the functional fluid is discharged from nozzles considered to be non-discharging in the third measurement discharge data.

In the drawing step according to this method, main scanning and sub-scanning are performed to move the workpiece and the droplet discharge head relative to each other, and complex discharge control is performed for discharging and applying the functional fluid. Nozzles that are considered to be continuously non-discharging among the plurality of nozzles therefore change in conjunction with sub-scanning. In the measurement discharge step, measurement discharge is performed on the basis of measurement discharge data that include third measurement discharge data that correspond to the so-called nozzle usage rate at which the number of discharging nozzles changes, and fourth measurement discharge data that have nozzle information in which the functional fluid is discharged from nozzles considered to be non-discharging in the third measurement discharge data. The drive conditions of the droplet discharge head can therefore be set in the adjustment step with consideration for variation of the droplet discharge amount caused by the nozzle usage rate. Specifically, a drawing pattern can be formed with even less variation in the droplet discharge amount.

The device in accordance with another aspect of the present invention has a drawing pattern that is composed of a functional material, and the device is characterized in that the drawing pattern is created using the pattern formation method according to the aforementioned aspects of the present invention. In this configuration, a pattern formation method is used that is capable of forming a drawing pattern having little variation in film thickness caused by fluctuation of the droplet discharge amount. It is therefore possible to provide a device that has stable characteristics. For example, when the device is a color filter, it is possible to obtain the desired optical characteristics in a color layer. The characteristics include transmittance, color, and saturation. When the device is an organic EL (electroluminescence) element, the desired quantity of functional fluid can be applied to form a positive hole implantation layer, a light-emitting layer, or an electron implantation layer, and an element can therefore be formed whose layers have the appropriate thickness. As a result, an organic EL element can be provided that emits light with high efficiency.

The electro-optical device in accordance with another aspect of the present invention is characterized in comprising the device according to the aforementioned aspect of the present invention. Since a device having stable characteristics is thereby obtained, an electro-optical device can also be provided that has stable electro-optical characteristics. For example, when the device is a color filter, it is possible to obtain an electro-optical device that comprises a color filter in which the optical characteristics of the color layer are as intended.

The electronic instrument in accordance with another aspect of the present invention is characterized in comprising the electro-optical device according to the aforementioned aspect of the present invention. A high-quality electronic instrument that has stable electro-optical characteristics can thereby be obtained.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure:

FIG. 14 includes a set of diagrams (a) and (b) of bitmaps showing the measurement discharge data in the third embodiment;

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
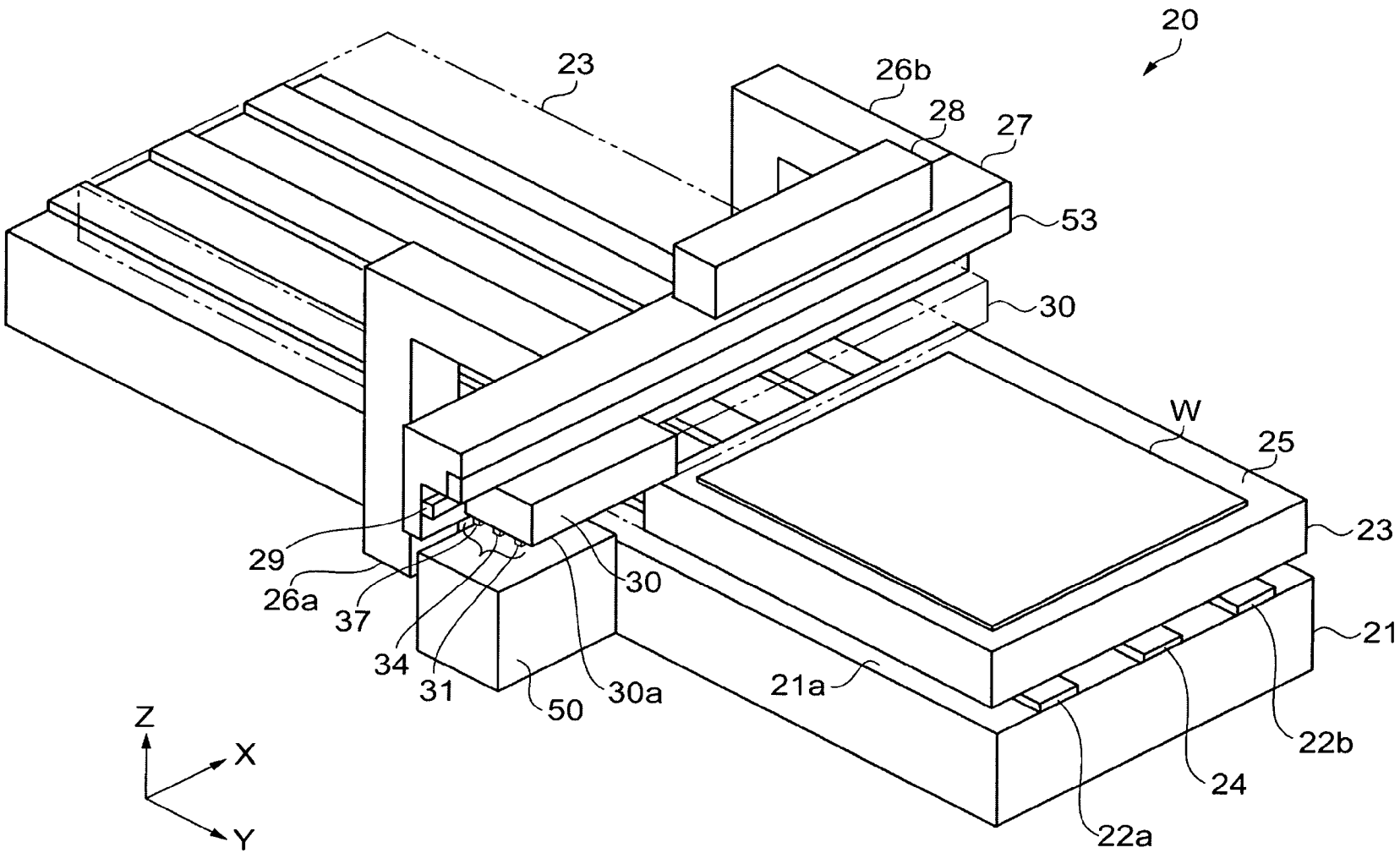
FIG. 1 is a schematic perspective view of a droplet discharge device showing the structure of the droplet discharge device.

Referring initially to FIG. 1, a—is illustrated in accordance with a first embodiment of the present invention.

As an embodiment of the present invention, an example will be described of a method for manufacturing a color filter by a process in which a functional fluid as a liquid that includes a material for forming a color layer is applied on a substrate as a workpiece, and three different color layers are formed. The functional fluid is applied on the substrate using a droplet discharge device that is capable of discharging and applying the functional fluid as droplets.

The droplet discharge device will first be described. FIG. 1 is a schematic perspective view showing the structure of the droplet discharge device. As shown in FIG. 1, the droplet discharge device 20 is provided with a substantially rectangular base 21, a stage 23 that is provided so as to be able to move in the Y-axis direction above the base 21, and a carriage 30 that faces the stage 23 and is capable of moving in the X-axis direction. A plurality of droplet discharge heads 31 through 39 (see FIG. 2) is mounted on the carriage 30. An electronic scale 50 as a measuring device for receiving the liquid discharged from the plurality of droplet discharge heads 31 through 39 and measuring the discharge amount of the liquid is also provided to a side surface of the base 21.

A pair of guide rails 22*a*, 22*b* extending in the Y-axis direction are provided on the upper surface 21*a* of the base 21 that extend along the entire width in the Y-axis direction. The stage 23 is structured so as to move in the Y-axis direction through the use of, for example, a threaded shaft (drive shaft) that extends in the Y-axis direction along the pair of guide rails 22*a*, 22*b*, a screw-type linear movement mechanism provided with a ball nut that meshes with the threaded shaft, and a Y-axis motor (not shown) for receiving a prescribed pulse signal and rotating the threaded shaft forward and backward. Specifically, when a drive signal corresponding to a prescribed number of steps is presented to the Y-axis motor, the Y-axis motor rotates forward or backward, and the stage 23 can move in or out at a prescribed speed along the Y-axis direction an amount that corresponds to the same number of steps. In this case, the operation by which the carriage 30 and the stage 23 are brought facing each other, and the stage 23 is moved in the Y-axis direction, is referred to as main scanning.

Furthermore, a main scanning position detection device 24 is provided parallel to the pair of guide rails 22*a*, 22*b* on the upper surface 21*a* of the base 21 and is capable of measuring the position of the stage 23 in the Y-axis direction.

A substrate fastening mechanism (not shown) that operates by suction is provided to the mounting surface 25 of the stage 23, and a substrate, or workpiece, W placed on the mounting surface 25 can be fixed in a prescribed position.

The base 21 is provided with a pair of support stands 26*a*, 26*b* that extend upward from the side surfaces, and a guide member 27 is set on the pair of support stands 26*a*, 26*b* so as to extend over the base 21 in the X-axis direction. The guide member 27 extends further than the width of the base 21 in the X-axis direction, and one end thereof is placed so as to protrude outward on the side of the support stand 26*a*.

A guide rail 29 that extends in the X-axis direction is mounted on the lower side of the guide member 27 along the entire width of the guide member 27 in the X-axis direction. A storage tank 28 for accommodating the liquid is provided on the upper side of the guide member 27, and the liquid can be fed from the storage tank 28 to the plurality of droplet discharge heads 31 through 39.

The carriage 30 is configured so as to be moved in the X-axis direction along the guide rail 29 by, for example, a threaded shaft (drive shaft) that extends in the X-axis direction along the guide rail 29, a screw-type linear movement mechanism provided with a ball nut that meshes with the threaded shaft, and an X-axis motor (not shown) for receiving a prescribed pulse signal and rotating the threaded shaft forward and backward. When a drive signal corresponding to a prescribed number of steps is presented to the X-axis motor, the X-axis motor rotates forward or backward, and the carriage 30 can move back and forth in the X-axis direction an amount that corresponds to the same number of steps. In this case, the operation by which the carriage 30 and the stage 23 are brought facing each other, and the carriage 30 is moved in the X-axis direction is referred to as sub-scanning. A sub-scanning position detection device 53 is provided between the guide member 27 and the carriage 30, and the device is capable of measuring the position of the carriage 30 in the X-axis direction. Accordingly, when the discharge amount of liquid discharged from the plurality of droplet discharge heads 31 through 39 is measured, the X-axis motor is actuated to move the carriage 30 towards the support stand 26*a*, and the plurality of droplet discharge heads 31 through 39 and the electronic scale 50 are positioned so as to face each other.

Figure 2:
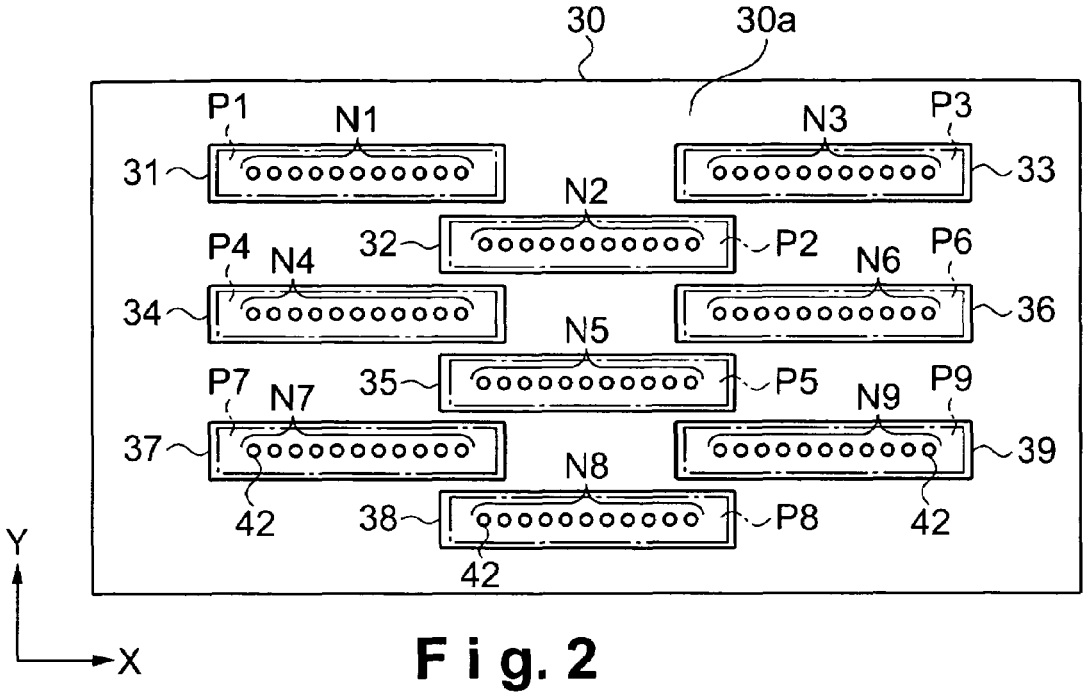
FIG. 2 is a plan view showing the positions of the droplet discharge heads in the carriage.

FIG. 2 is a plan view showing the positions of the droplet discharge heads in the carriage as viewed specifically from the stage 23.

As shown in FIG. 2, a first droplet discharge head 31 through ninth droplet discharge head 39 are arranged three at a time in the X-axis direction and Y-axis direction on the head-mounting surface 30*a* of the carriage 30. The droplet discharge head 31 is provided with a nozzle plate P1 that has a nozzle row N1 in which a plurality of nozzles 42 is provided at substantially equal intervals. The other droplet discharge heads 32 through 39 are also configured in the same manner. In this case, the nozzle rows N1, N2, N3 that correspond to the three droplet discharge heads 31, 32, 33 arranged in the X-axis direction are mounted on the carriage 30 so that the plurality of nozzles 42 at substantially equal intervals is continuous as viewed from the Y-axis direction. The same applies in the other droplet discharge heads 34, 35, 36 and droplet discharge heads 37, 38, 39. Accordingly, when droplets are discharged from the droplet discharge heads 31, 32, 33 while the substrate W is moved in the Y-axis direction relative to the carriage 30, the discharged droplets are applied at substantially equal intervals in the X-axis direction.

In this case, a functional fluid that includes a red (R) material for forming a color layer is fed to the first droplet discharge head 31 through third droplet discharge head 33. In the same manner, a functional fluid that includes a green (G) material for forming a color layer is fed to the fourth droplet discharge head 34 through sixth droplet discharge head 36. A functional fluid that includes a blue (B) material for forming a color layer is fed to the seventh droplet discharge head 37 through ninth droplet discharge head 39. Specifically, functional fluids having three different colors can be discharged at approximately the same time.

Figure 3:
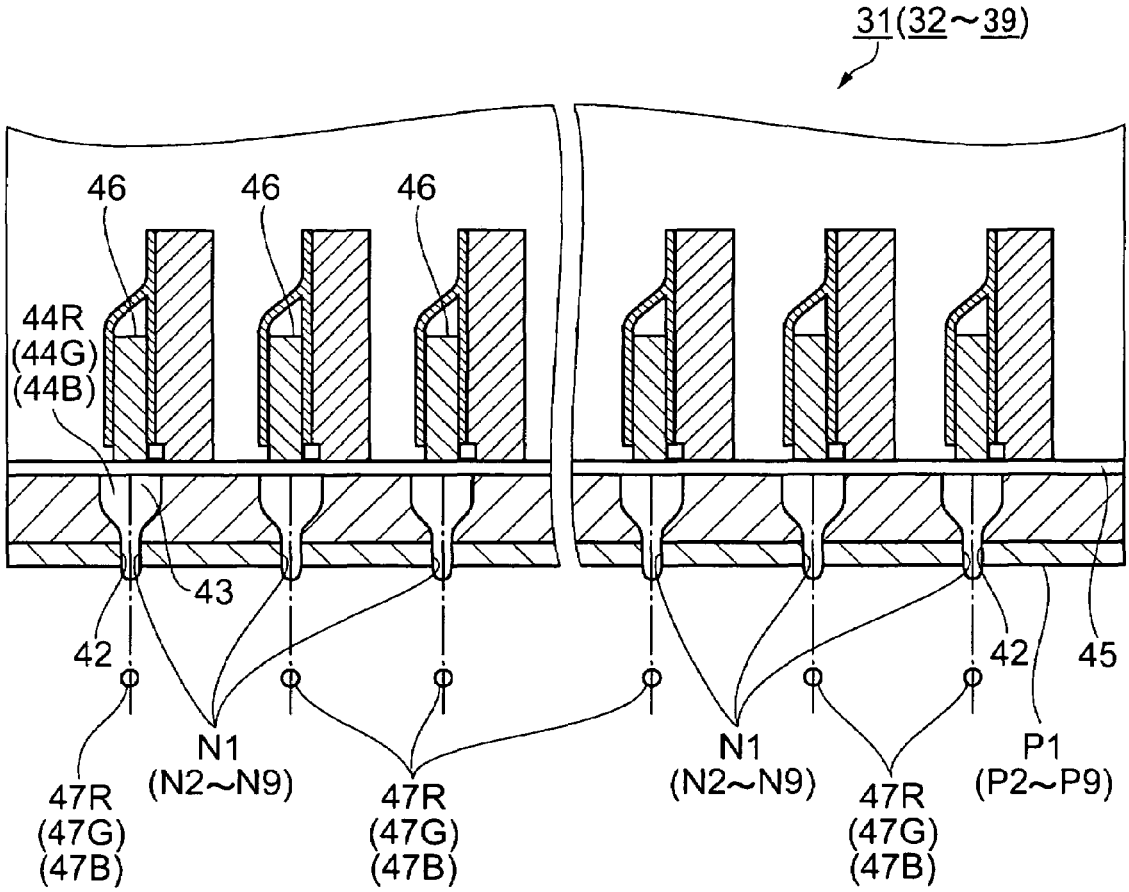
FIG. 3 is a schematic cross sectional view showing the structures of the droplet discharge head.

FIG. 3 is a schematic sectional view showing the essential structure of a droplet discharge head. As shown in FIG. 3, the droplet discharge head 31 is provided, for example, with a plurality of cavities 43 that are communicated with the nozzles 42 of the nozzle row N1, and a plurality of piezoelectric elements 46 that are provided in positions that correspond to the plurality of cavities 43 via a vibrating plate 45.

When a pulse drive signal for driving the piezoelectric elements 46 is received, the piezoelectric elements 46 expand, the vibrating plate 45 vibrates in the vertical direction, and the functional fluid filling the cavities 43 is compressed. As a result, the functional fluid is discharged as droplets from the nozzle row N1 of the droplet discharge head 31. The same structure is also provided in the other droplet discharge heads 32 through 39.

A colored fluid material 44R as a functional fluid that includes a red (R) material for forming a color layer is thus filled into the cavities 43 of the first droplet discharge head 31 through third droplet discharge head 33 and discharged as microdroplets 47R from the nozzle rows N1 through N3. A colored fluid material 44G as a functional fluid that includes a green (G) material for forming a color layer is filled into the cavities 43 of the fourth droplet discharge head 34 through sixth droplet discharge head 36 and discharged as microdroplets 47G from the nozzle rows N4 through N6. A colored fluid material 44B as a functional fluid that includes a blue (B) material for forming a color layer is thus filled into the cavities 43 of the seventh droplet discharge head 37 through ninth droplet discharge head 39 and discharged as microdroplets 47B from the nozzle rows N7 through N9.

This type of structure for compressing the liquid that is filled into the droplet discharge heads 31 through 39 is not limited to a piezoelectric element 46. It is also possible to employ an electrostatic system for vibrating the vibrating plate 45 by electrostatic adsorption, or a bubble system in which the liquid is heated by an electrothermal conversion element to generate a bubble, and the liquid is thereby compressed and discharged from a nozzle 42 as a droplet.

Figure 4:
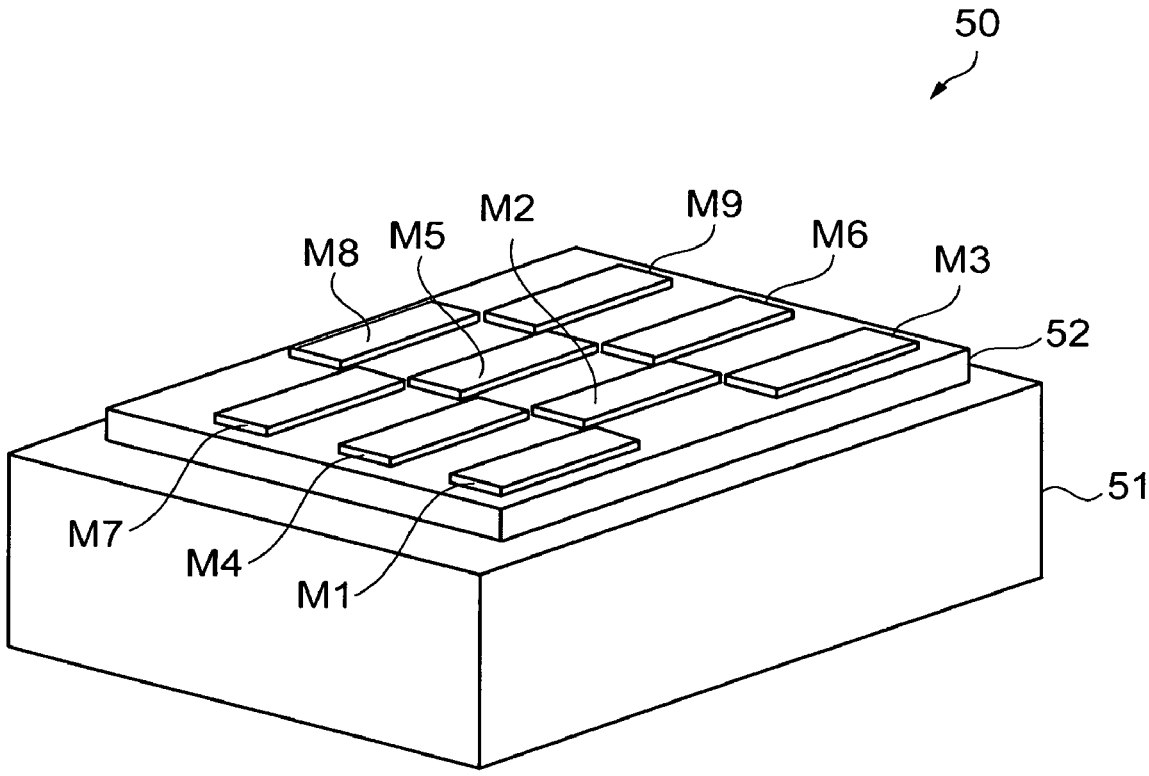
FIG. 4 is a schematic perspective view showing the structure of the electronic scale.

FIG. 4 is a schematic perspective view showing the structure of the electronic scale. As shown in FIG. 4, the electronic scale 50 comprises a main body 51 that has a weight detection mechanism and a conversion unit for converting the detected weight into an electrical signal, and a weighing platform 52 for receiving the weighed object. Nine receptacles M1 through M9 used for measurement are provided to the upper surface of the weighing platform 52, and the plates receive the functional fluid as the weighed object from the droplet discharge heads 31 through 39.

Sponge-like absorbers are provided to the measurement receptacles M1 through M9 to reliably catch the droplets that are discharged from the nozzle rows N1 through N9 and prevent the droplets from scattering to the outside from the measurement receptacles M1 through M9.

In this case, the smallest unit measurable by the electronic scale 50 is 1 mg. However, since the discharged droplets are on the order of nanograms (ng), the droplet discharge heads 31 through 39 are driven with the number of discharges set to 2000 to 3000 to obtain a quantity of the functional fluid that can be measured, and the functional fluid is discharged as droplets from the nozzle rows N1 through N9. It is apparent that this type of measurement discharge is performed by each droplet discharge head 31 through 39.

Figure 5:
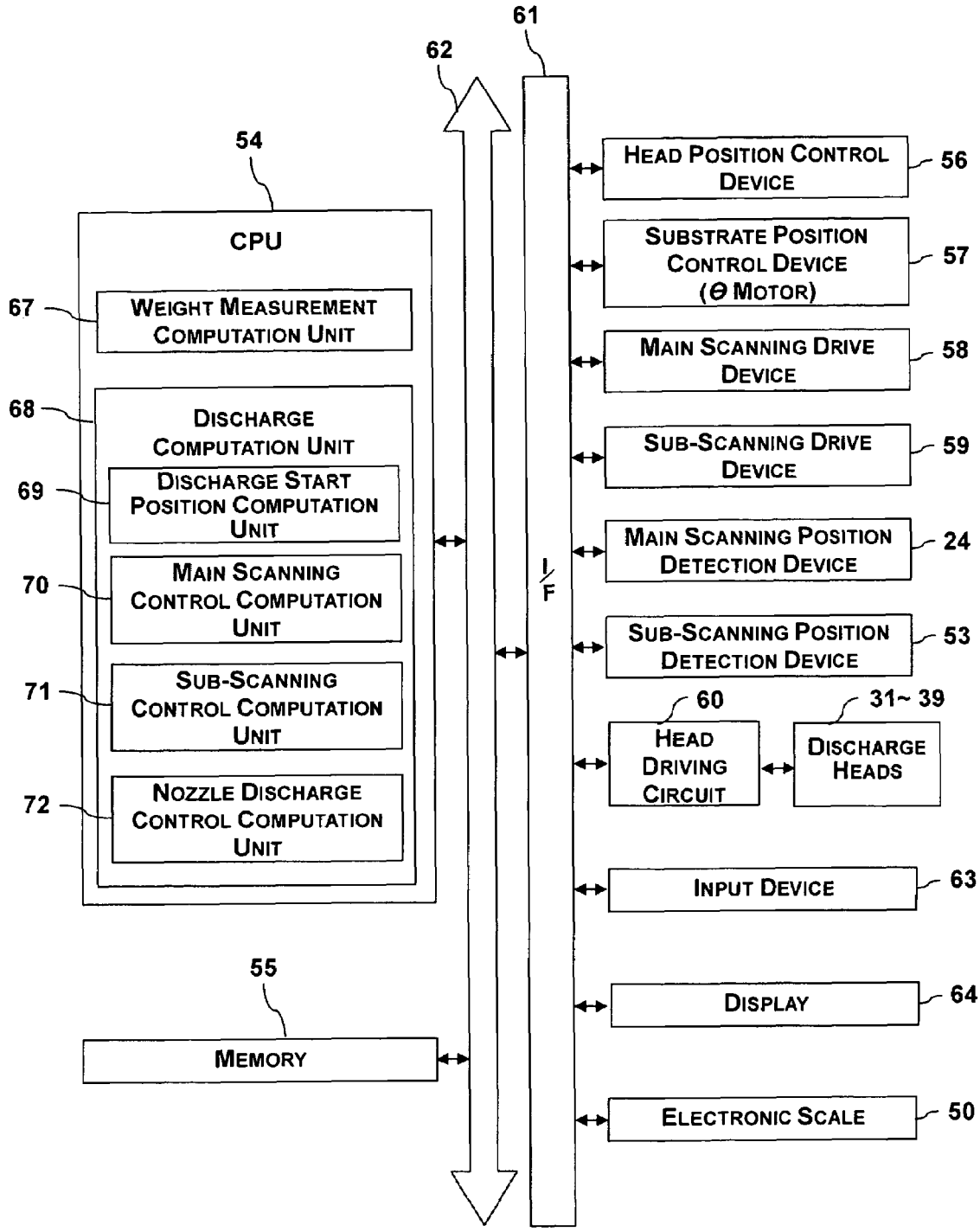
FIG. 5 is a block diagram showing the electrical control system of the droplet discharge device.

The electrical control system of the droplet discharge device 20 will next be described. FIG. 5 is a block diagram showing the electrical control system of the droplet discharge device. As shown in FIG. 5, the droplet discharge device 20 has a CPU (computational processing device) 54 as a processor for performing various types of computational routines, and memory 55 for storing various types of information.

A head driving circuit 60 for driving a head position control device 56, a substrate position control device 57, a main scanning drive device 58, a sub-scanning drive device 59, the main scanning position detection device 24, the sub-scanning position detection device 53, and the droplet discharge heads 31 through 39 is connected to the CPU 54 via an input/output interface 61 and a bus 62. An input device 63, a display 64, and the electronic scale 50 are also connected to the CPU 54 via the input/output interface 61 and the bus 62.

The concept of the memory 55 includes semiconductor memory such as RAM, ROM, and the like, or an external storage device such as a hard disk or a CD-ROM. In functional terms, the memory is provided with a storage region for storing a software program that describes a procedure for controlling the operation of the droplet discharge device 20; a storage region for storing positional data for positioning the droplets in a prescribed region on the substrate W; a storage region for storing the amount of main scanning movement of the substrate W in the main scanning direction (Y-axis direction); a storage region that functions as a work area, a temporary file, or the like for the CPU 54; and various other types of storage regions.

The CPU 54 performs control so that the functional fluid is discharged as droplets in a prescribed position on the surface of the substrate W according to a software program stored in the memory 55. As components for performing specific functions, the CPU 54 has a weight measurement computation unit 67 for performing a computation to obtain a weight measurement using the electronic scale 50, and a discharge computation unit 68 for performing computation so that droplets are discharged by the droplet discharge heads 31 through 39.

The discharge computation unit 68 specifically has a discharge start position computation unit 69 for positioning the droplet discharge heads 31 through 39 in an initial position in which droplet discharge is initiated, a main scanning control computation unit 70 for computing the control whereby the substrate W is moved at a prescribed speed in the main scanning direction, and a sub-scanning control computation unit 71 for computing the control whereby the droplet discharge heads 31 through 39 are moved a prescribed amount according to sub-scanning in the sub-scanning direction (X-axis direction). Furthermore, the discharge computation unit 68 has various types of functional computation units such as a nozzle discharge control computation unit 72 and the like for performing computation in order to select any of the plurality of nozzles 42 in the droplet discharge heads 31 through 39 and to control whether the functional fluid is discharged.

The aforementioned functions were described as being carried out by a software program using the CPU 54, but it is also possible to use electronic circuits when the aforementioned functions can be carried out by independent electronic circuits (hardware) that does not utilize the CPU.

First Embodiment

Figure 6:
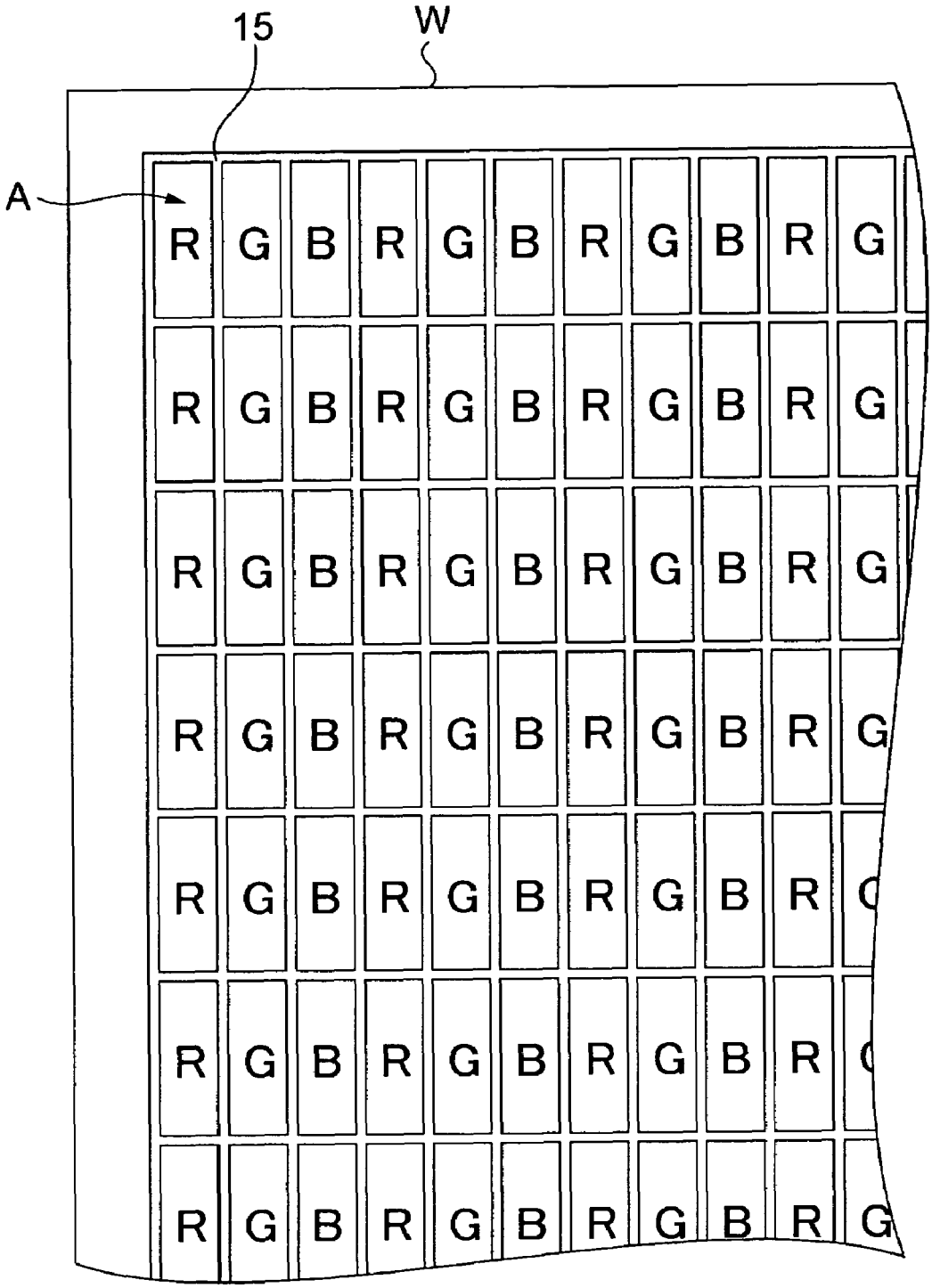
FIG. 6 is a schematic plan view showing a color filter.

A color filter and a method for manufacturing the same will next be described as an embodiment of the device of the present invention. FIG. 6 is a schematic plan view showing a color filter.

As shown in FIG. 6, the color filter of the present embodiment has a divider portion (bank) 15 for partitioning a plurality of drawing regions A into a matrix on the substrate W, and three colors (RGB) of color layers formed within the partitioned drawing regions A. This color filter has a so-called striped system in which color layers of the same color are arranged linearly in the same direction.

The divider portion 15 is formed using a publicly known material and method. In an example of this method, a photosensitive resin material is applied on the substrate W, and the divider portion 15 is formed by a photolithography technique. Light that passes through the substrate W is preferably blocked by the divider portion 15, and a divider portion 15 composed of a photosensitive resin material may be formed on a patterned thin metal film that has light-blocking properties.

The three colors (RGB) of color layers are formed by using the aforementioned droplet discharge device 20 to discharge colored fluid materials 44R, 44G, 44B having three colors that include the material for forming a color layer in the plurality of drawing regions A from the corresponding droplet discharge heads 31 through 39.

Figure 7:
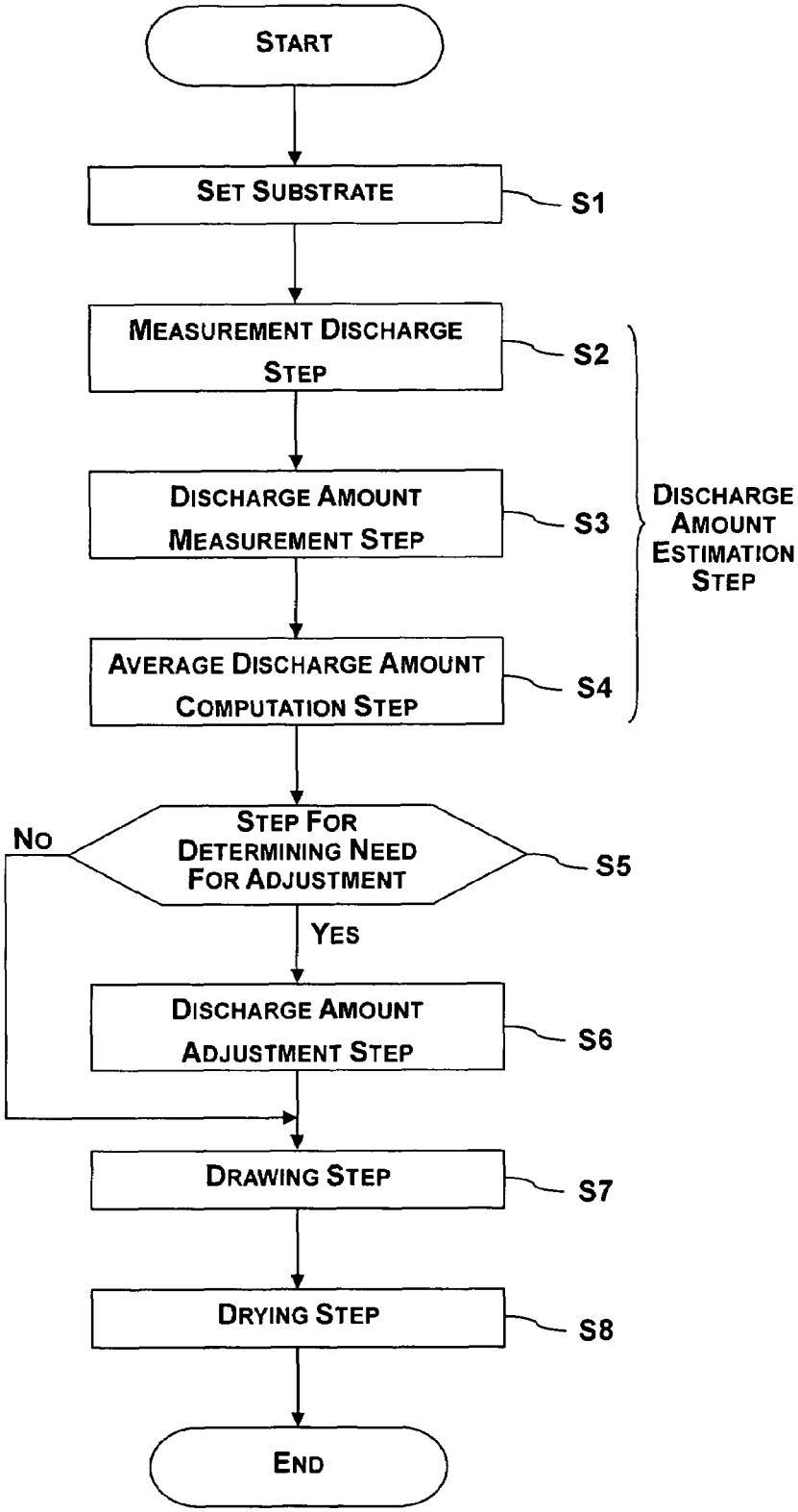
FIG. 7 is a flowchart showing the method for manufacturing the color filter.

FIG. 7 is a flowchart showing the method for manufacturing the color filter. As shown in FIG. 7, the method for manufacturing the device and color filter of the present embodiment comprises a substrate setting step (step S1) whereby the substrate W in which the divider portion 15 is formed is set in the droplet discharge device 20, and the droplet discharge device 20 is provided with initial settings; a measurement discharge step (step S2) for discharging droplets a set number of times from the droplet discharge heads 31 through 39; a discharge amount measurement step (step S3) as a step for measuring the discharge amount of the discharged functional fluid; and an average discharge amount computation step (step S4) as a step for computing an average discharge amount from the measured value of the discharge amount and the number of discharges (discharge count). Since the rate of discharge from the droplet discharge heads 31 through 39 can be estimated from the process that includes steps S2 through S4, these three steps are referred to collectively as a discharge amount estimation step. This manufacturing method also comprises a determination step (step S5) for determining whether it is necessary to adjust the discharge amount of droplets discharged from the droplet discharge heads 31 through 39; a discharge amount adjustment step (step S6) as a step for changing the drive conditions of the droplet discharge heads 31 through 39 to adjust the discharge amount of the functional fluid when adjustment is determined to be necessary; a drawing step (step S7) for discharging and applying the colored fluid material 44R, 44G, 44B as droplets in the plurality of drawing regions A of the substrate W; and a drying step (step S8) as a pattern formation step for drying the discharged and applied colored fluid material 44R, 44G, 44B to form three colors (RGB) of color layers.

Step S1 in FIG. 7 is the substrate setting step. In step S1, the substrate W is mounted on and secured to the stage 23 of the droplet discharge device 20, as shown in FIG. 1. The carriage 30 is then moved over the electronic scale 50 and positioned so that the measurement receptacles M1 through M9 (see FIG. 4) and the droplet discharge heads 31 through 39 are facing each other. The weight of the measurement receptacles M1 through M9 prior to droplet discharge is then measured and set as zero. The process then proceeds to step S2.

Step S2 in FIG. 7 is the measurement discharge step. In step S2, the stage 23 is moved in the main scanning direction in the same manner as in the subsequent drawing step (step S7) in a state I which the carriage 30 is fixed on the electronic scale 50. Droplets are then discharged towards the measurement receptacles M1 through M9 of the electronic scale 50 for each of the droplet discharge heads 31 through 39, i.e., the nozzle rows N1 through N9. The carriage 30 is provided with a first droplet discharge head 31 through ninth droplet discharge head 39, but the operation of only the first droplet discharge head 31 will be described in order to simplify the description.

Figure 8:
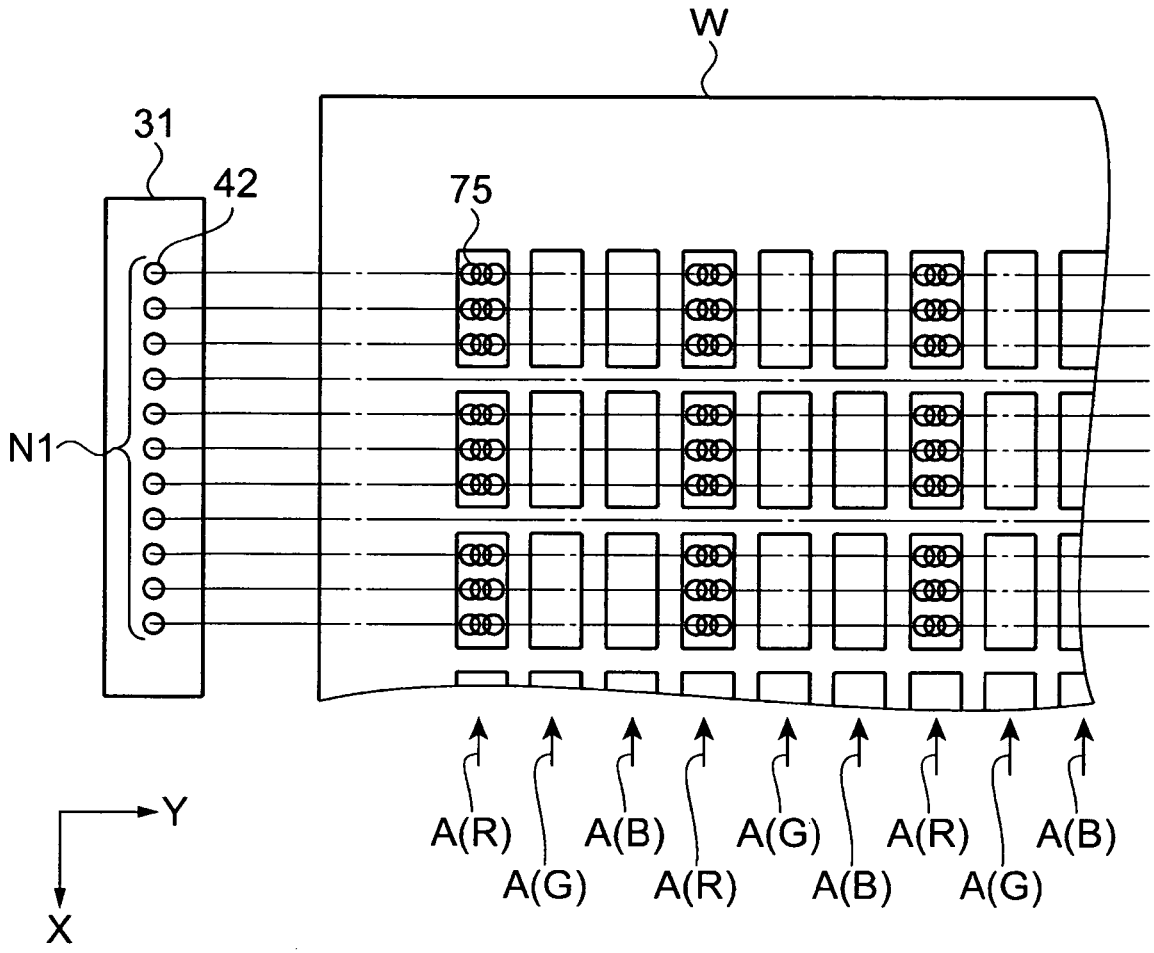
FIG. 8 is a schematic view showing the method by which the functional fluid is discharged.

FIG. 8 is a schematic view showing the method by which the functional fluid is discharged, and specifically shows the method by which droplets are discharged in the subsequent drawing step (step S7). As shown in FIG. 8, the substrate W is provided with red (R) drawing regions A, green (G) drawing regions A, and blue (B) drawing regions A onto which droplets are discharged from the nozzle rows N1 through N9. In a single red (R) drawing region A, a droplet of red colored fluid material 44R is discharged and applied three times from three nozzles 42.

In the operation in which the nozzle row N1 discharges to the red (R) drawing regions A, droplets are discharged three times from the nozzles 42 to the red (R) drawing regions A when the nozzle row N1 passes over the red (R) drawing regions A. Droplets are not discharged on the green (G) drawing regions A, the blue (B) drawing regions A, or between the drawing regions A (specifically, in the divider portion 15), and droplets are discharged three times when the nozzle row N1 passes over the red (R) drawing regions A again. This discharge operation is repeated in the main scanning direction (Y-axis direction) as the substrate W and the carriage 30 move relative to each other. Accordingly, predetermined landing positions 75 for the droplets discharged from a single nozzle 42 are set in three places in the red (R) drawing regions A. On the substrate W, predetermined landing positions 75 are set in three places in the subsequent red (R) drawing regions A, but there are no predetermined landing positions 75 in the green (G) drawing regions A and blue (B) drawing regions A.

Figure 9:
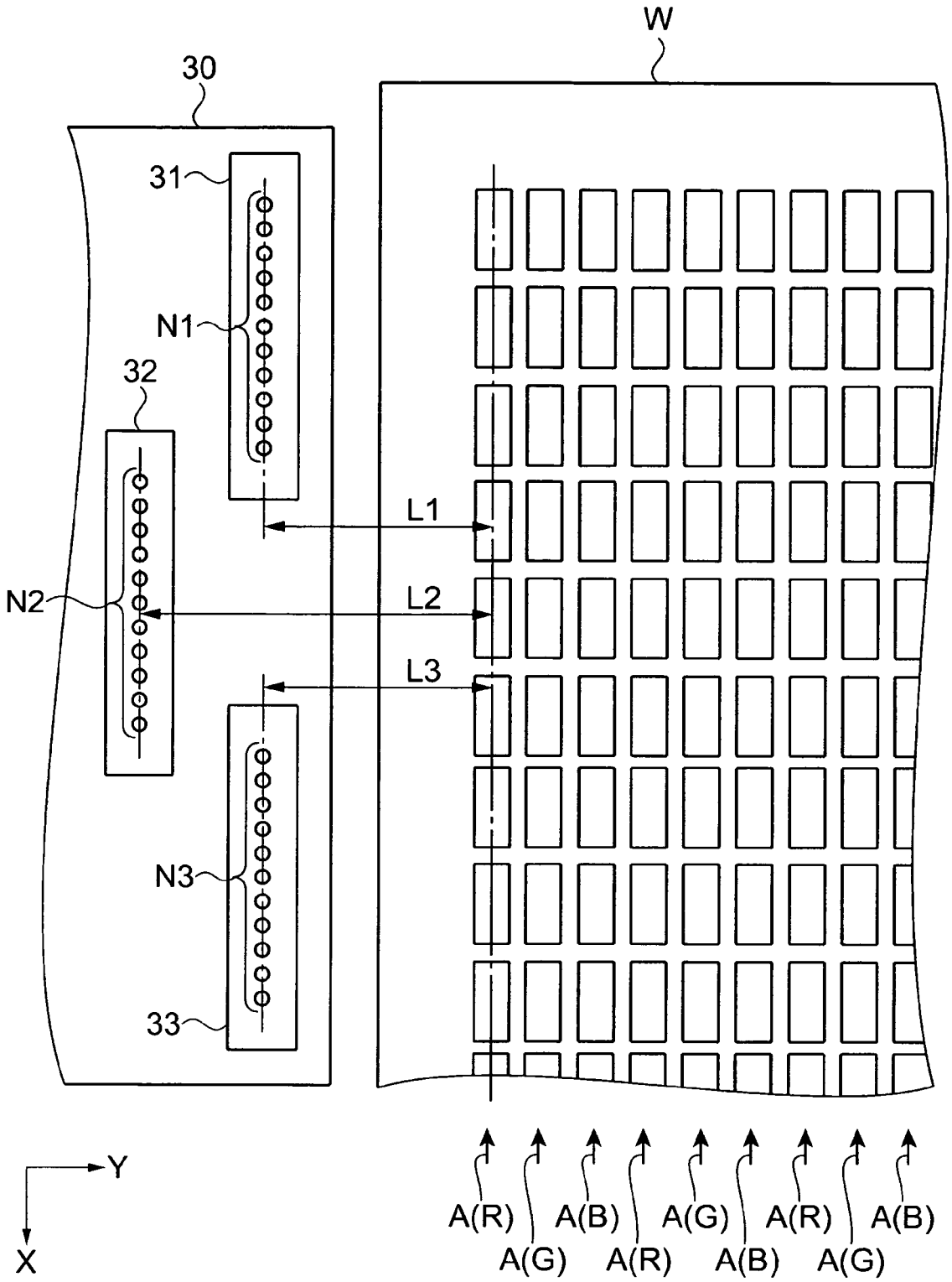
FIG. 9 is a schematic view showing the discharge timing of the functional fluid.

FIG. 9 is a schematic view showing the discharge timing of the functional fluid. As shown in FIG. 9, the carriage 30 is provided with a first droplet discharge head 31, a second droplet discharge head 32, and a third droplet discharge head 33 for discharging droplets in the red (R) drawing regions A. The reference symbol L1 indicates the distance from the nozzle row N1 of the first droplet discharge head 31 to the center of the red (R) drawing regions A in which droplets are first discharged from the nozzle row N1. The reference symbol L2 indicates the distance from the nozzle row N2 of the second droplet discharge head 32 to the center of the red (R) drawing regions A in which droplets are first discharged from the nozzle row N2. In the same manner, the reference symbol L3 indicates the distance from the nozzle row N3 of the third droplet discharge head 33 to the center of the red (R) drawing regions A in which droplets are first discharged from the nozzle row N3.

The nozzle row N1 and the nozzle row N3 are positioned on substantially the same line in the X-axis direction and are disposed substantially parallel to the red (R) drawing regions A. The distances L1 and L3 are therefore substantially the same. Since the nozzle row N1 and the nozzle row N2 are arranged parallel to each other at a prescribed interval in the Y-axis direction, there is a prescribed distance between L1 and L2.

The operation in which the nozzle rows N1 through N3 discharge in the red (R) drawing regions A will be described. The substrate W and the carriage 30 are moved relative to each other in the Y-axis direction, and droplets are discharged when nozzle row N1 and nozzle row N3 reach the red (R) drawing regions A. At that time, nozzle row N2 has not reached the red (R) drawing regions A, and therefore does not discharge droplets. When the substrate W and the carriage 30 move relative to each other in the Y-axis direction, and nozzle row N2 reaches the red (R) drawing regions A, droplets are discharged from nozzle row N2. At this time, nozzle row N1 and nozzle row N3 are passing over the red (R) drawing regions A, and droplets are not discharged from nozzle row N1 and nozzle row N3. Accordingly, droplets are discharged from the first droplet discharge head 31 and the third droplet discharge head 33 with the same timing, and droplets are discharged from the second droplet discharge head 32 at a different timing from that of the first droplet discharge head 31.

As shown in FIG. 1, the main scanning position detection device 24 is provided between the base 21 and the stage 23. The relative positions of the carriage 30 and the substrate W that is placed on the stage 23 are measured by the main scanning position detection device 24.

In the measurement discharge step of step S2, the sub-scanning control computation unit 71 of the CPU 54 transmits carriage movement position data to the sub-scanning drive device 59, and the sub-scanning drive device 59 causes the carriage 30 to move to a position above the electronic scale 50. The main scanning control computation unit 70 of the CPU 54 transmits stage movement position data to the main scanning drive device 58, and the main scanning drive device 58 causes the stage 23 to move in the main scanning direction. The main scanning position detection device 24 transmits data relating to the position of the stage 23 to the nozzle discharge control computation unit 72 of the CPU 54. When the stage 23 is in a position in which the relative positions of nozzle row N1 and the predetermined landing positions 75 (see FIG. 8) are on the same line in the X-axis direction, the nozzle discharge control computation unit 72 presents the head driving circuit 60 with a signal as measurement discharge data for discharging droplets, and droplets are discharged from nozzle row N1. The operation whereby droplets are discharged in the predetermined landing positions 75 of the red (R) drawing regions A is repeated in synchrony with the movement of the stage 23, and discharge is terminated when droplets have been discharged a prescribed number of times. Specifically, droplets are discharged for the purpose of measurement based on information about the relative position of the substrate W in the main scanning direction and position data for positioning the droplets in the prescribed drawing regions A at a timing that corresponds to the relative movement of the substrate W. The process then proceeds to step S3.

Step S3 in FIG. 7 is the discharge amount measurement step. In step S3, the weight of the droplets discharged onto the measurement receptacles M1 through M9 of the electronic scale 50 is measured. The discharge amount is measured from the difference between the measured weight of the measurement receptacles M1 through M9 prior to discharge and the measured weight of the measurement receptacles M1 through M9 after discharge. As previously mentioned, droplets are actually discharged from droplet discharge heads 31 through 39 that correspond to fluid materials 44R, 44G, and 44B having three colors. Therefore, step S2 and step S3 are executed for each of the droplet discharge heads 31 through 39 to measure the discharge amount of the droplets discharged by each nozzle row N1 through N9. Step S2 and step S3 are therefore repeated nine times. The process then proceeds to step S4.

Step S4 in FIG. 7 is the average discharge amount computation step. In step S4, an average discharge amount is computed from the discharge amount of the functional fluid measured in step S3 and the number of discharges (discharge count) performed in step S2. The average discharge amount may be computed by a combination of basic arithmetic operations. For example, the method of computation used in the present embodiment involves dividing the weight difference of the measurement receptacle M1 before and after discharge by the number of discharges performed by the droplet discharge head 31. In this case, the average discharge amount of functional fluid (droplets) per discharge is computed for each of the first droplet discharge head 31 through ninth droplet discharge head 39. The process then proceeds to step S5.

Step S5 in FIG. 7 is the determination step. In step S5, the average discharge amount of the droplet discharge heads 31 through 39 that was computed in step S4 is compared with a prescribed discharge amount, and a determination is made as to whether an adjustment is necessary. For example, in the present embodiment, a total of nine droplets of the colored fluid material 44R are discharged in the red (R) drawing regions A. The average discharge amount of the droplet discharge head 31 for nine droplets is therefore compared with a prescribed discharge amount needed in order to form a film (red color layer) that has the desired optical characteristics (transmittance, color, saturation), and a determination is made as to whether an adjustment is necessary. In this case, adjustment is determined to be necessary when the difference between the aforementioned prescribed discharge amount and the average discharge amount of the droplet discharge head 31 for nine droplets is outside an allowable range of ±3% with respect to the aforementioned prescribed discharge amount. A determination is also made as to whether adjustment is necessary by comparing the average discharge amounts of the droplet discharge heads 31, 32, and 33 that discharge colored fluid material 44R of the same color. For example, an adjustment is determined to be necessary when the average discharge amount of the droplet discharge heads 31, 32, and 33 is outside an allowable range of ±1% with respect to the average value. The same applies for the other droplet discharge heads 34 through 39. The process proceeds to step S6 when adjustment is determined to be necessary in step S5. When adjustment is determined to be unnecessary, the process proceeds to step S7.

Step S6 in FIG. 7 is the discharge amount adjustment step. In step S6, the discharge amounts of each of the first droplet discharge head 31 through ninth droplet discharge head 39 are adjusted. The discharge amount is adjusted by adjusting the voltage amplitude of the waveform of the voltage that drives the piezoelectric element 46 (see FIG. 3). The relationship between the voltage amplitude and the discharge amount is that the discharge amount increases when the voltage amplitude is increased, and the discharge amount is reduced as the voltage amplitude is reduced. The discharge amount for each of the first droplet discharge head 31 through ninth droplet discharge head 39 is adjusted using this relationship. The discharge amount is adjusted so as to approach a prescribed discharge amount, and so as to reduce the difference between the discharge amounts of droplet discharge heads that discharge the same color of colored fluid material. In this case, the discharge amount is adjusted so as to fall within the aforementioned allowable range. Steps S2 through S4 may therefore be repeated again until the prescribed discharge amount is verified.

Step S7 in FIG. 7 is the drawing step. In step S7, the stage 23 and the carriage 30 are driven, and droplets of the colored fluid materials 44R, 44G, 44B that correspond to the red (R) drawing regions A, the green (G) drawing regions A, and the blue (B) drawing regions A of the substrate W are discharged and applied from the nozzle rows N1 through N9 of the first droplet discharge head 31 through ninth droplet discharge head 39. The droplets are positioned in the drawing regions A as previously described. A prescribed quantity of droplets of the colored fluid materials 44R, 44G, 44B is applied in each drawing region A, and the droplets spread and expand. The process then proceeds to step S8.

Step S8 in FIG. 7 is the drying step. In step S8, the colored fluid materials 44R, 44G, 44B that were discharged and applied are dried and fixed at once, and color layers having three colors are formed. The drying method is preferably a decompression drying method that is capable of evenly evaporating the solvent included in the colored fluid materials 44R, 44G, 44B. This method makes it possible to form a color layer that has a more uniform film thickness.

The effects of the aforementioned first embodiment are as follows.

(1) The quantity of droplets discharged when the droplets are discharged intermittently is sometimes different from the quantity of droplets discharged when the droplets are continuously discharged from the nozzles 42. A reason for this is considered to be that the compatibility of impedance matching of the head driving circuit 60 and the piezoelectric element 46 with respect to the signal of an alternating current component is different when the piezoelectric element 46 is driven continuously and when the piezoelectric element 46 is driven intermittently. Another possible reason is that the resistance of the fluid in the flow channel from the storage tank 28 that stores the discharge fluid to the droplet discharge heads 31 through 39 varies according to whether the droplets are continuously discharged or intermittently discharged.

In the discharge amount estimation step of the first embodiment described above, the average discharge amount per discharge was computed for each of the droplet discharge heads 31 through 39 by a process in which droplets were discharged at the same timing as the timing at which droplets were discharged into the red (R) drawing regions A of the substrate W in the drawing step, the weight of the discharged droplets was measured, and the result was divided by the number of discharges. The average discharge amount for each of the droplet discharge heads 31 through 39 was then compared with a prescribed discharge amount, and when it was necessary to adjust the discharge amount, the discharge amount was adjusted in the adjustment step so as to match the prescribed discharge amount. Droplets were discharged and applied on a substrate, or workpiece, W to form layers having three colors. Accordingly, when the discharge amount of droplets discharged from the nozzles 42 is measured, it is possible to obtain a measurement that approximates the discharge amount when droplets are actually discharged on the substrate W, compared to a case in which droplets are continuously discharged to measure the discharge amount. As a result, it is possible to cause the discharge amount of droplets discharged onto the substrate W to approach the desired discharge amount.

(2) The quantity of droplets discharged during simultaneous discharge from all of the nozzles 42 of a single droplet discharge head sometimes differs from the quantity of droplets discharged when a smaller number of nozzles are used. A reason for this is considered to be that the compatibility of impedance matching of the head driving circuit 60 and the piezoelectric elements 46 is different when the piezoelectric elements 46 of the droplet discharge head are all driven simultaneously and when a small number of piezoelectric elements 46 are driven. Another possible reason is that the resistance of the fluid in the flow channel from the storage tank 28 to the droplet discharge heads 31 through 39 varies according to whether droplets are discharged from all of the droplet discharge heads or from a small number of droplet discharge heads.

In the discharge amount estimation step of the first embodiment described above, a plurality (nine) of droplet discharge heads 31 through 39 are provided to the droplet discharge device 20, and when the discharge amount of droplets discharged from the droplet discharge heads 31 through 39 is measured, the discharge amount is measured for droplets that are discharged from the nozzle rows N1 through N9 at the timing at which the droplet discharge heads 31 through 39 discharge droplets in the drawing regions A of the substrate W. Accordingly, when the discharge amount of droplets discharged from the nozzle rows N1 through N9 is measured, a measurement can be obtained that is closer to the discharge amount that occurs when droplets are discharged on the substrate W than when the discharge amount is measured by discharging droplets from all of the droplet discharge heads 31 through 39. As a result, it is possible to cause the discharge amount of droplets discharged onto the substrate W to approach the desired discharge amount.

(3) In the method for manufacturing a color filter of the first embodiment described above, the discharge amount of the droplets discharged from the droplet discharge heads 31 through 39 is adjusted in the adjustment step so as to approach the desired discharge amount and to reduce the difference in the discharge amount among a plurality (three) of droplet discharge heads that discharge the same color of colored fluid material. This ensures that the discharge amount is substantially the same for droplets that are discharged from a plurality (three) of droplet discharge heads that discharge the same color of colored fluid material. Variations in the discharge amount among the plurality of drawing regions A in which droplets are discharged onto the substrate W are thereby minimized, and it is possible to form color layers of the same color in which there is little difference in optical characteristics (transmittance, color, saturation).

Second Embodiment

Figure 10:
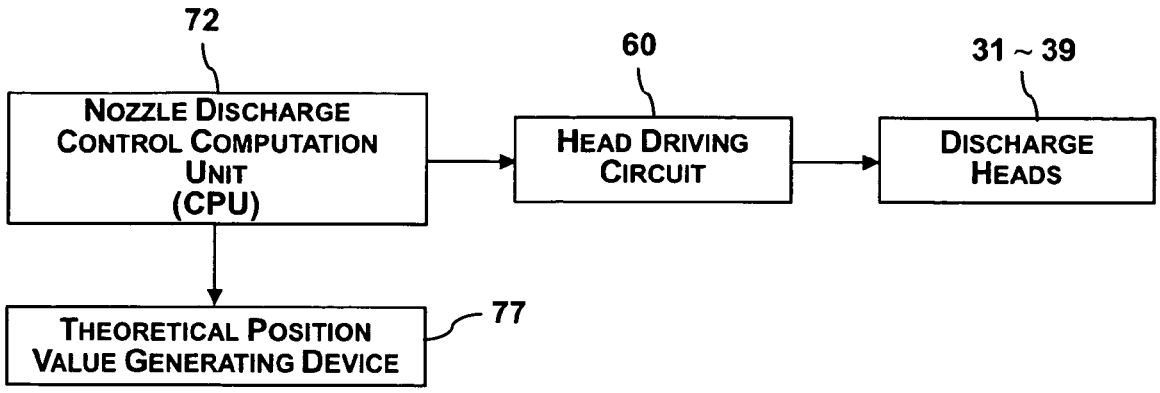
FIG. 10 is a block diagram showing the electrical control system by which the discharge amount is measured in accordance with a second embodiment of the present invention.

A second embodiment of the discharge amount measurement method of the present invention will next be described according to FIG. 10. FIG. 10 is a block diagram showing the electrical control system by which the discharge amount is measured.

As shown in FIG. 10, the droplet discharge device 20 is provided with a device 77 for generating a theoretical position value. All other aspects are the same as in the block diagram of FIG. 5 that shows the electrical control system of the droplet discharge device of the first embodiment.

In the first embodiment described above, the main scanning control computation unit 70 of the CPU 54 transmits stage movement position data to the main scanning drive device 58, and the main scanning drive device 58 drives the stage 23. The main scanning position detection device 24 transmits data relating to the position of the stage 23 to the nozzle discharge control computation unit 72 of the CPU 54. The nozzle discharge control computation unit 72 transmits a discharge signal based on the aforementioned position data and droplet arrangement data that are stored in the memory 55 to the head driving circuit 60 at the timing at which droplets are discharged.

In the present embodiment, instead of the main scanning position detection device 24 transmitting the position data of the stage 23, the theoretical position value generating device 77 generates theoretical position data and transmits the theoretical position data to the nozzle discharge control computation unit 72. The nozzle discharge control computation unit 72 presents the head driving circuit 60 with a discharge signal for discharging droplets based on the aforementioned theoretical position data and the aforementioned arrangement data. The head driving circuit 60 receives the discharge signal and transmits a drive signal for driving the piezoelectric elements 46 to the first droplet discharge head 31 through ninth droplet discharge head 39, and droplets are discharged.

The theoretical position value generating device 77 may be composed of a circuit for generating position data, or may be configured so as to store the position data of the stage 23 that are outputted from the main scanning position detection device 24 during main scanning in which the carriage 30 and the stage 23 are moved relative to each other, and to reproduce and output the stored position data.

The discharge amount measurement method of the aforementioned second embodiment has the following merits in addition to the merits of the first embodiment described above.

(1) Theoretical position data are generated by the theoretical position value generating device 77 and transmitted to the nozzle discharge control computation unit 72 of the CPU 54, and the nozzle discharge control computation unit 72 generates a discharge signal (timing signal) for discharging droplets on the basis of the theoretical position data and the droplet arrangement data stored in the memory 55. Therefore, compared to a method in which the stage 23 is driven in order to acquire the position data of the stage 23 from the main scanning position detection device 24, the nozzle discharge control computation unit 72 can easily determine the timing for discharging droplets and transmit a discharge signal. As a result, the discharge amount can be measured using a small amount of energy and without moving the stage 23.

Third Embodiment

Figure 11:
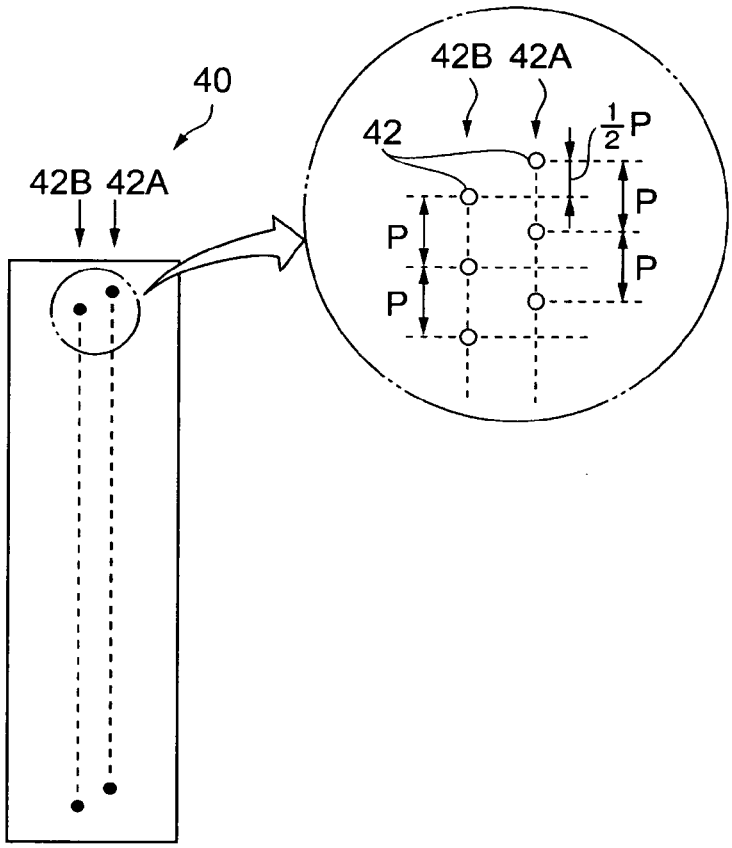
FIG. 11 is a schematic plan view showing a droplet discharge head in accordance with a third embodiment of the present invention.

A third embodiment of the discharge amount measurement method of the present invention will next be described according to FIGS. 11 through 14. FIG. 11 is a schematic plan view showing a droplet discharge head in the third embodiment; FIGS. 12A, 12B, 13A and 13B are schematic views showing the method by which liquid is discharged in the third embodiment; and FIG. 14 is a schematic view showing the measurement discharge data.

As shown in FIG. 11, the droplet discharge head 40 in the present embodiment is provided with two nozzle rows 42A, 42B that comprise a plurality (180) of nozzles 42. A plurality of nozzles 42 is arranged at a substantially equal nozzle pitch P in each nozzle row 42A, 42B, and the nozzle rows 42A, 42B are arranged so as to be offset from each other by one half nozzle pitch.

The ten nozzles 42 positioned on the ends of the nozzle rows 42A, 42B are not used, and there are 160 effective nozzles in each row.

In this case, the number and positioning of the droplet discharge heads 40 in the carriage 30 in the droplet discharge device 20 are the same as shown in FIG. 2. The number of droplet discharge heads 40 mounted in the carriage 30 is not limited to nine, and there may be three droplet discharge heads that correspond to the fluid materials 44R, 44G, 44B having three colors.

In the color filter as the device of the present embodiment, the arrangement of drawing regions A in which three colors (RGB) of color layers are formed is the same as shown in FIG. 6, and the drawing regions A are larger than in the aforementioned first embodiment. The desired number of droplets to be deposited in the drawing regions A is therefore greater. The present embodiment is a method for manufacturing a color filter that includes a discharge amount measurement method based on the method of liquid discharge assumed to be used in such cases.

In the method for discharging a liquid in the color filter manufacturing method of the present embodiment, the composition of the measurement discharge step and the drawing step is changed with respect to the first embodiment described above. A drawing step is provided for discharging and applying a prescribed quantity of liquid as droplets on a drawing region A through the use of discharge control in which a plurality of principal scans for moving the droplet discharge head 40 and the substrate W relative to each other in the Y-axis direction is combined with sub-scanning for moving the droplet discharge head 40 in the X-axis direction during the plurality of principal scans.

Figure 12A:
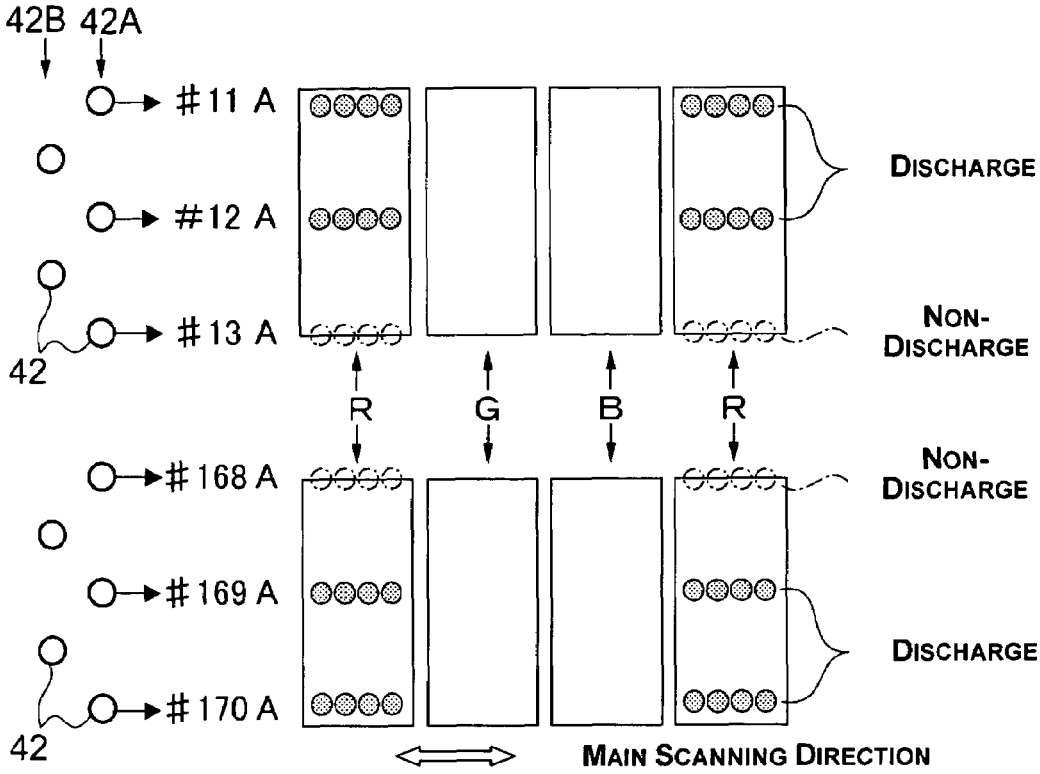
FIGS. 12A and 12B are schematic views showing the method by which liquid is discharged in accordance with the third embodiment of the present invention.
Figure 12B:
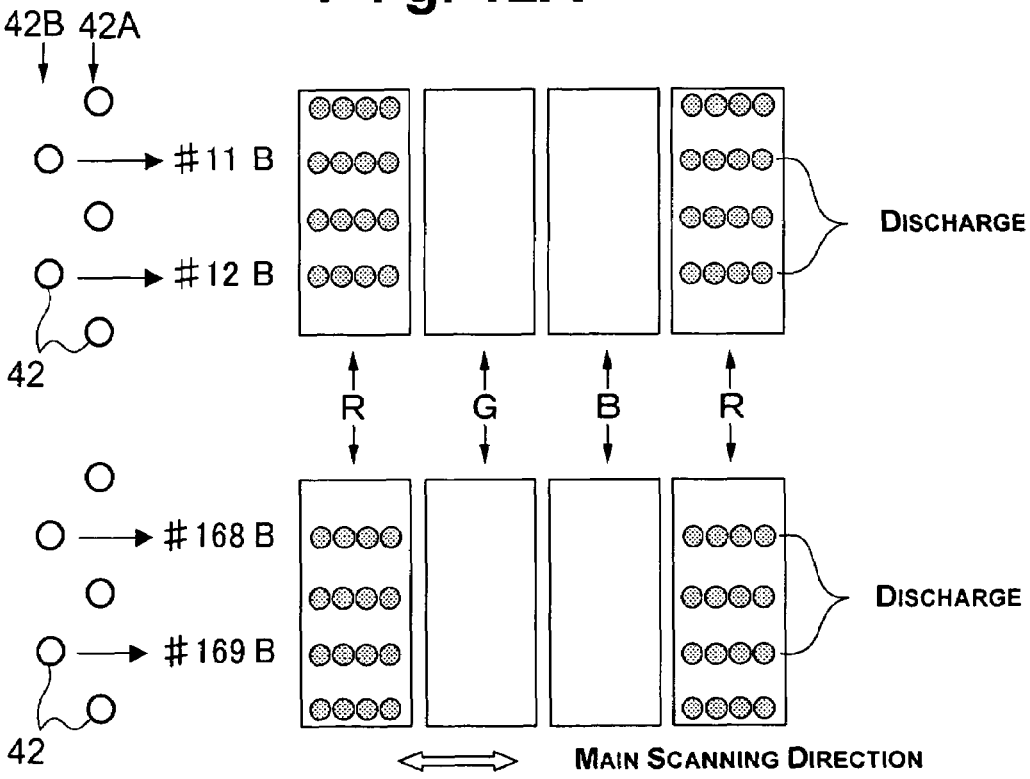

FIGS. 12A and 12B show the positioning of the droplets discharged onto the drawing regions A by the initial main scanning in the drawing step. For example, when red colored fluid material 44R is discharged as the liquid (functional fluid) from the droplet discharge head 40, nozzle row 42A first reaches the red (R) drawing region A, followed by nozzle row 42B.

As shown in FIG. 12A, the effective nozzles of nozzle row 42A are numbered in sequence from #11 to #170. In the positional relationship between the size of the drawing regions A and the nozzle row 42A that arrives at the drawing regions A, the effective nozzles include non-discharging nozzles 42 and nozzles 42 that continuously discharge droplets to the drawing regions A. It is also apparent that since droplets are not discharged in the green (G) and blue (B) drawing regions A, all of the effective nozzles are non-discharging. For example, at the ends of the effective nozzles, the nozzles numbered 11A and 12A are discharging nozzles with respect to one red (R) drawing region A, and the nozzles numbered 169A and 170A are discharging nozzles with respect to the other red (R) drawing region A. The nozzles numbered 13A and 168A are non-discharging nozzles.

As shown in FIG. 12B, the effective nozzles of the other nozzle row 42B are numbered in sequence from #11 to #170. Non-discharging nozzles 42 and nozzles 42 that continuously discharge droplets to the drawing regions also occur among the effective nozzles of nozzle row 42B. For example, at the ends of the effective nozzles, the nozzles numbered 11B and 12B are discharging nozzles with respect to one red (R) drawing region A, and the nozzles numbered 168B and 169B are discharging nozzles with respect to the other red (R) drawing region A. The nozzles numbered 13B and 170B are non-discharging nozzles. Discharge data in this type of main scanning are inputted to the droplet discharge device 20 as a bitmap in which the vertical axis indicates the nozzle number, and the horizontal axis indicates the discharge timing according to each nozzle row 42A, 42B, and the discharge data are stored in the memory 55.

Even when a plurality of droplets is discharged so as to land in the drawing regions A as shown in FIGS. 12A and 12B, main scanning may be repeated in the same manner to apply droplets in the same position in the main scanning direction when the amount of colored fluid material 44R is inadequate. However, since the application of droplets becomes uneven, it is preferred that the plurality of nozzles 42 arriving at the drawing regions A discharge the fluid in a different position.

Figure 13A:
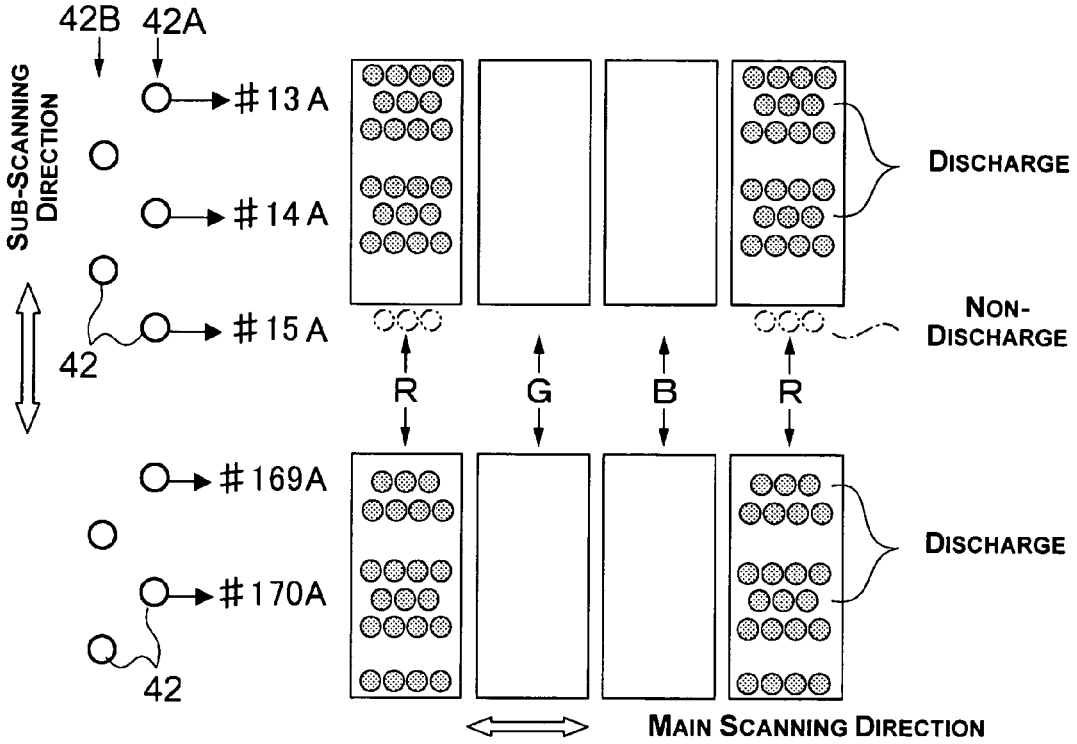
FIGS. 13A and 13B are schematic views showing the method by which liquid is discharged in accordance with the third embodiment of the present invention.
Figure 13B:
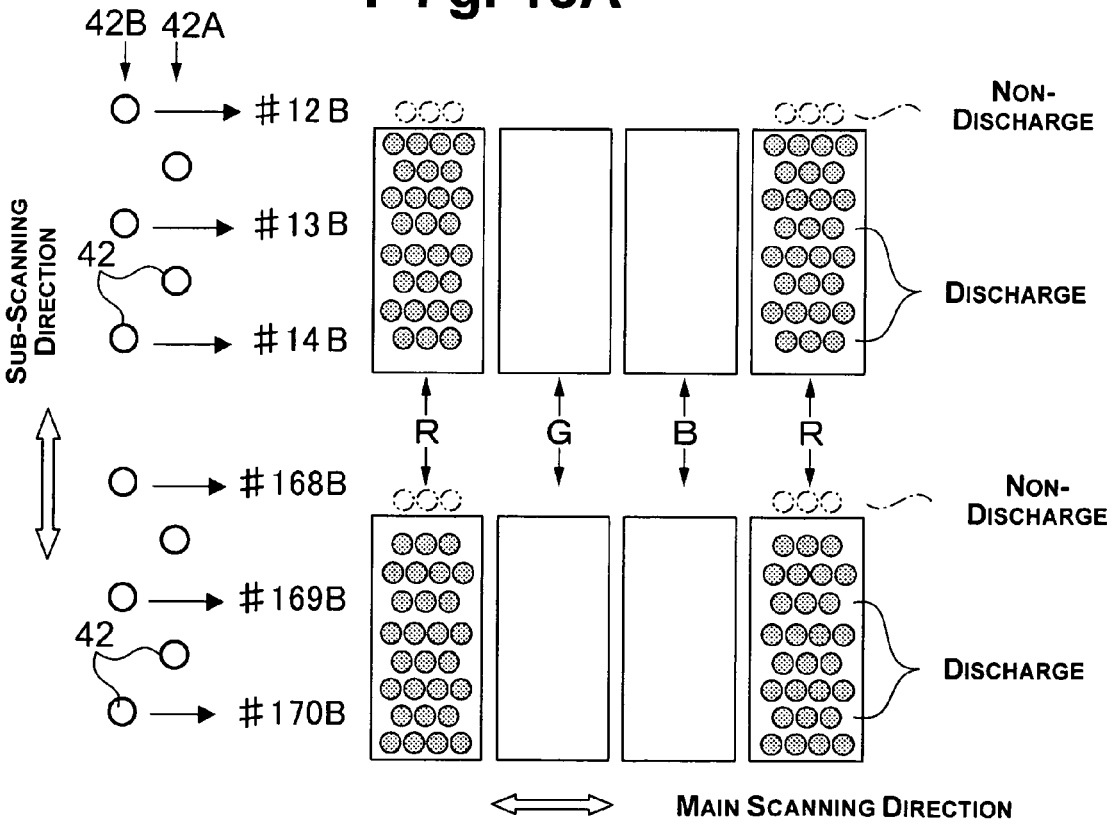

FIGS. 13A and 13B are schematic views showing a state in which inadequate droplets are discharged by performing sub-scanning for moving the droplet discharge head 40 in the X-axis direction, and performing main scanning with the plurality of nozzles 42 that arrives at the drawing regions A in a different position.

As shown in FIG. 13A, when the droplet discharge head 40 performs sub-scanning so that the nozzles numbered 13A and 14A in, e.g., the nozzle row 42A of the droplet discharge head 40 arrive at the drawing regions A on one side, the nozzles numbered 11A, 12A, and 15A that have discharged in the previous main scanning then become non-discharging nozzles.

The selection of discharging nozzles and non-discharging nozzles then changes in the same manner in the nozzle row 42B, as shown in FIG. 13B. Discharge data in the main scanning that follows sub-scanning are inputted to the droplet discharge device 20 as a bitmap in which the vertical axis indicates the nozzle number, and the horizontal axis indicates the discharge timing according to each nozzle row 42A, 42B, and the discharge data are stored in the memory 55.

In the drawing step as described above in the discharge amount measurement method of the present embodiment, measurement discharge data are generated in accordance with the change between discharging nozzles and non-discharging nozzles that occurs with each principal scan, thereby enabling a droplet discharge amount to be measured in a state that approaches the state in which an actual color layer is formed by discharge.

FIG. 14 is a series of diagrams (a) and (b) of bitmaps showing the measurement discharge data of the third embodiment. As shown in the diagram (a) of FIG. 14, the measurement discharge data in the discharge amount measurement method of the present embodiment include a first bitmap as first measurement discharge data that have information about continuously non-discharging nozzles among the plurality of nozzles 42, and a second bitmap as second measurement discharge data that have nozzle information in which the liquid is continuously discharged from nozzles that were considered to be non-discharging. In the measurement discharge step, the droplet discharge head 40 is driven using at least the first bitmap and the second bitmap, the number of discharges is set so that a measurable quantity is obtained, and the liquid is discharged as droplets.

In the measurement discharge step, the droplet discharge head is driven using the first bitmap and the second bitmap for each of the two nozzle rows 42A and 42B.

As shown in the diagram (b) of FIG. 14, the measurement discharge data used in the measurement discharge step include a third bitmap as third measurement discharge data wherein nozzles considered to be continuously non-discharging among the plurality of nozzles in the first bitmap is changed in conjunction with sub-scanning, and a fourth bitmap as fourth measurement discharge data that have nozzle information in which the functional liquid is discharged from nozzles considered non-discharging nozzles in the third bitmap. These bitmaps are also generated and used for each of the two nozzle rows 42A, 42B, and the droplet discharge amount of each of the nozzle rows 42A, 42B is measured in the measurement step.

The first and second bitmaps reflect the ratio of the number of discharging nozzles with respect to the number of effective nozzles, i.e., the nozzle usage rate, based on the discharge data in the main scanning shown in FIGS. 12A and 12B.

The third and fourth bitmaps correspond to changes in the selection of discharging nozzles while the nozzle usage rate is reflected based on the discharge data in the main scanning that follows the sub-scanning shown in FIGS. 13A and 13B.

When the discharge data in the drawing step are reflected directly in the generation of the measurement discharge data, all-nozzle non-discharge information in which none of the nozzles 42 discharge the fluid is continuously generated in accordance with the arrangement of drawing regions A in which no fluid is discharged and applied. Since idle time in which there is no discharge is thereby eliminated in the measurement discharge step, the first through fourth bitmaps of the present embodiment are used as measurement discharge data in a state in which a portion of the all-nozzle non-discharge information is deleted.

In the bitmaps in which the vertical axis indicates the nozzle number and the horizontal axis indicates the discharge timing, "1" indicates selection, and "0" indicates non-selection. When a nozzle is selected, a drive signal that corresponds to a single discharge is presented to the piezoelectric element 46 that corresponds to the nozzle 42 of the droplet discharge head 40, but a plurality of drive signals may also be continuously presented. As described in the aforementioned second embodiment, the discharge timing on the horizontal axis may be based on the substrate position information in the primary scanning of the substrate, or workpiece, W.

The effects of the aforementioned third embodiment are as follows.

(1) In the discharge amount measurement method of the third embodiment, first through fourth bitmaps that reflect the nozzle usage rate in the drawing step are used as measurement discharge data. Therefore, droplets are discharged by a prescribed number of discharges from all of the nozzles 42, and measurement discharge can be performed that reflects the actual discharge conditions in the drawing step. The droplet discharge amount can therefore be measured in a state that more closely approaches the conditions in which the liquid is actually discharged and applied.

(2) In the discharge amount measurement method of the third embodiment, first through fourth bitmaps are generated as measurement discharge data for each nozzle row 42A, 42B of the droplet discharge head 40, and discharge is performed for measurement. The droplet discharge amount can therefore be measured for each nozzle row 42A, 42B in a state that more closely approaches the conditions in which the liquid is actually discharged and applied.

(3) In the discharge amount measurement method of the third embodiment, the first through fourth bitmaps as measurement discharge data are generated in a state in which a portion of the all-nozzle non-discharge information is deleted from the discharge data in the drawing step. It is therefore possible to eliminate idle time in which droplets are not discharged in the measurement discharge step, and to efficiently perform discharge for measurement.

(4) In the method for manufacturing a color filter according to the third embodiment, the discharge amount of droplets discharged from each droplet discharge head 40 is corrected by a discharge amount measurement method that uses the first through fourth bitmaps. The appropriate quantity of colored fluid materials 44R, 44G, 44B is therefore applied to each drawing region A in the drawing step, and it is possible to form triple-color (RGB) layers having little variation in film thickness after the drying step.

Fourth Embodiment

Figure 15A:
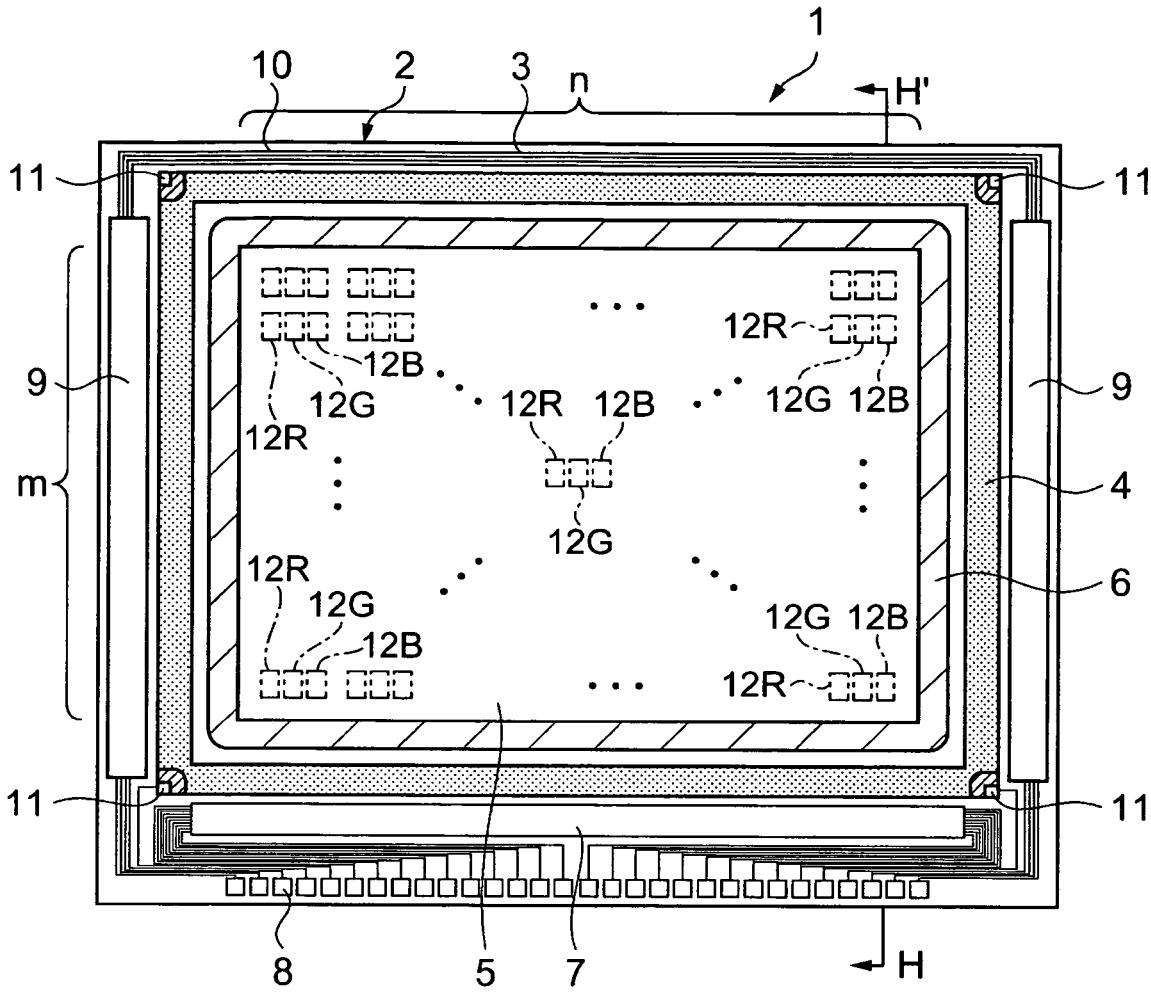
FIG. 15A is a schematic front view showing the structure of the liquid crystal display device.
Figure 15B:
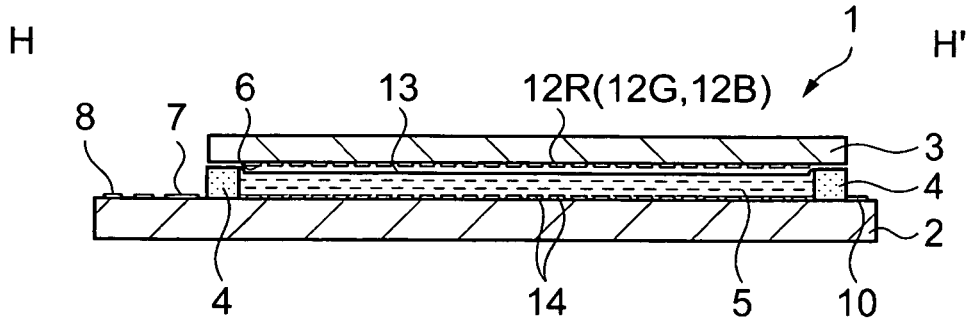
FIG. 15B is a sectional view along a section line H-H' in FIG. 15A.

A liquid crystal display device that is a fourth embodiment of the electro-optical device of the present invention will next be described. FIGS. 15A and 15B schematically show the structure of the liquid crystal display device, wherein FIG. 15A is a front view, and FIG. 15B is a sectional view along line H-H' in FIG. 15A.

As shown in FIGS. 15A and 15B, the liquid crystal display device 1 of the present embodiment is provided with a TFT array substrate 2 and an opposing substrate 3 that form a pair, a seal member 4 that is a light-curable seal for bonding together the substrates 2, 3, and liquid crystal 5 that is filled into the region enclosed by the seal member 4. The seal member 4 is formed in the shape of a closed frame in a region in the plane of the substrates, is not provided with a liquid crystal injection hole, and is formed so as to have no trace of being sealed with a sealant.

A peripheral boundary 6 composed of a light-blocking material is formed in a region that is inside the region in which the seal member 4 is formed. In the region outside the seal member 4, a data line drive circuit 7 and mounting terminals 8 are formed along one edge of the TFT array substrate 2, and scanning line drive circuits 9 are formed along the two edges that are adjacent to the aforementioned edge. A plurality of wires 10 for forming connections between the scanning line drive circuits 9 disposed on both sides of the image display region is provided to the remaining edge of the TFT array substrate 2. An inter-substrate conductor 11 for conducting electricity between the TFT array substrate 2 and the opposing substrate 3 is positioned in at least one corner of the opposing substrate 3.

Instead of forming the data line drive circuit 7 and the scanning line drive circuits 9 on the TFT array substrate 2, a TAB (Tape Automated Bonding) substrate in which a drive LSI is installed and in which a group of terminals is formed in the peripheral portion of the TFT array substrate 2 may, e.g., be electrically and mechanically connected via an anisotropic conduction film. A phase difference plate, a polarizing plate, and the like are arranged in a prescribed orientation in the liquid crystal display device 1 according to the type of liquid crystal 5 used, i.e., according to a TN (Twisted Nematic) mode, STN (Super Twisted Nematic) mode, or other operating mode, or a normally white mode/normally black mode classification. However, these components are not shown in the drawing.

A color filter having red (R), green (G), and blue (B) color layers 12R, 12G, 12B as a drawing pattern is also formed together with a protective film in the opposing substrate 3 in a region that faces the pixel electrodes (described hereinafter) of the TFT array substrate 2. The color layers 12R, 12G, 12B are manufactured using any of the color filter manufacturing methods described in the aforementioned first through third embodiments. An opposing electrode 13 is also provided on the TFT array substrate 2 side of the color filter.

In the image display region of the liquid crystal display device 1 that has this type of structure, a plurality of pixels is arranged in a matrix having m columns and n rows, and a TFT (Thin Film Transistor) element used for pixel switching is formed in each of the pixels. A data line for supplying a pixel signal is electrically connected to the source of each TFT, a scanning line for supplying a scanning signal is electrically connected to the gate of each TFT, and a pixel electrode 14 is electrically connected to the drain of each TFT.

A scanning line is electrically connected to the gate of each TFT, and a scanning signal in the form of a pulse is applied to the scanning line at a prescribed timing.

A pixel electrode 14 is electrically connected to the drain of each TFT, and the TFT switching element is turned on for a certain period of time, whereby a pixel signal supplied from the data line is written to each pixel at a prescribed timing. A pixel signal having a prescribed level that is written to the liquid crystal via the pixel electrode 14 is thus retained for a certain period of time between the opposing electrodes 13 of the opposing substrate 3. The amount of light transmitted by the liquid crystal 5 varies according to the level of the pixel signal, and since the liquid crystal display device 1 is provided with a color filter, the liquid crystal display device 1 can display a color image.

The effects of the aforementioned fourth embodiment are as described below.

(1) In the liquid crystal display device 1 of the fourth embodiment, the color filter of the opposing substrate 3 is manufactured using any of the color filter manufacturing methods described in the aforementioned first through third embodiments. The color filter therefore has layers 12R, 12G, 12B of three colors in which there is little variation in film thickness, and the prescribed optical characteristics (transmittance, color, saturation) are consistently ensured. The liquid crystal display device 1 therefore has high display quality and a low occurrence of uneven color and the like.

Fifth Embodiment

Figure 16:
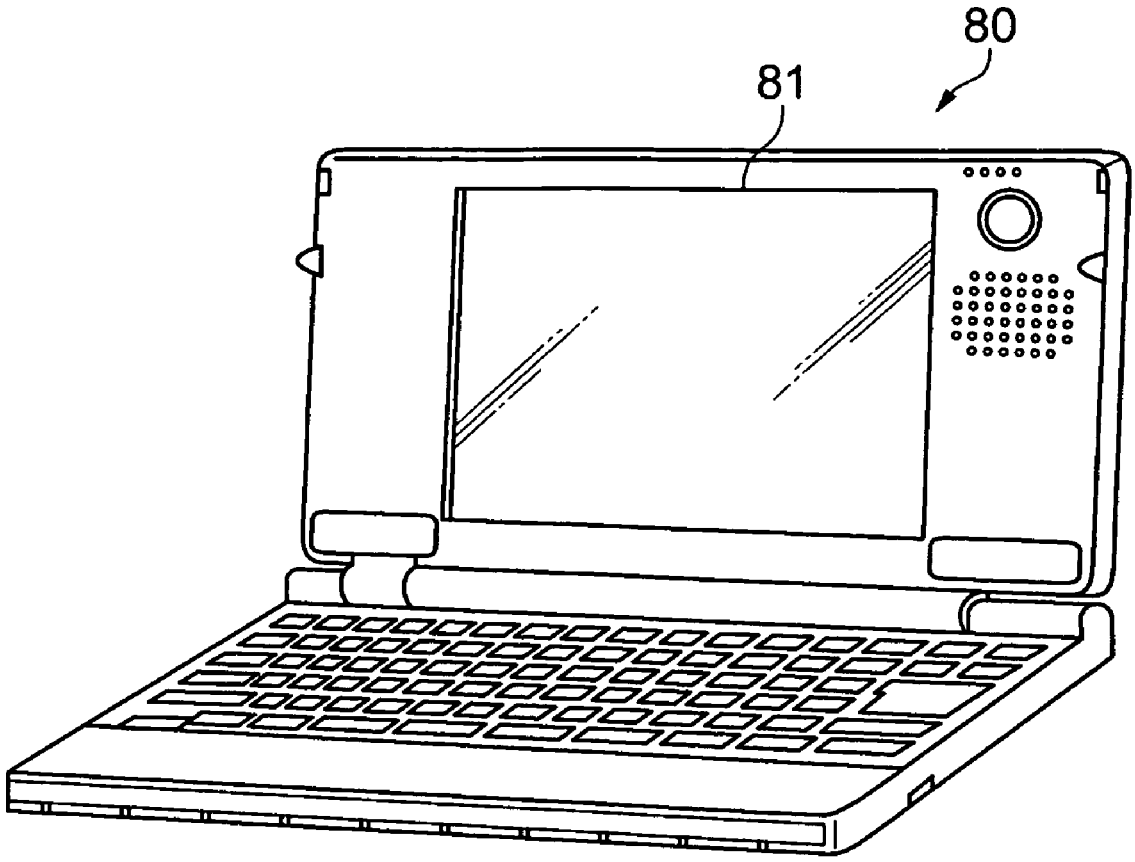
FIG. 16 is a schematic perspective view showing the personal computer.

A personal computer as an embodiment of the electronic instrument of the present invention will next be described. FIG. 16 is a schematic perspective view showing the personal computer. The personal computer (PC) 80 as the electronic instrument of the present embodiment is provided with a display device 81 as a unit for displaying information. The liquid crystal display device 1 of the aforementioned fourth embodiment is provided to this display device 81.

The effects of the aforementioned fifth embodiment are as follows.

(1) The PC 80 of the fifth embodiment is equipped with a liquid crystal display device 1 that has high display quality and a low occurrence of uneven color or the like. It is therefore possible to provide a PC 80 in which image information and the like that includes color information can be accurately recognized.

As described above in the embodiments of the present invention, various modifications can be made to the aforementioned embodiments in a range that does not depart from the intended scope of the present invention. Examples of modifications other than the aforementioned embodiments are described hereinafter.

Modified Example 1

The electronic scale 50 was used to measure the weight of droplets in order to measure the discharge amount in the first embodiment described above. However, the present invention is not limited by this configuration, and the discharge amount may be measured by measuring the volume of droplets. For example, droplets may be discharged into grooves having the same width, and a volume may be measured by a method in which the volume is estimated from the length of liquid occupying the grooves.

Modified Example 2

The measurement receptacles M1 through M9 of the electronic scale 50 were provided for each of the droplet discharge heads 31 through 39 in the first embodiment described above to measure the discharge amount of droplets discharged from the nozzle rows N1 through N9 of the droplet discharge heads 31 through 39. However, the discharge amount of droplets discharged from the nozzles 42 may be measured by providing a measurement receptacle for each nozzle 42. Adjusting the discharge amount for each nozzle 42 makes it possible to minimize differences in the discharge amounts between nozzles.

Modified Example 3

In the second embodiment described above, the nozzle discharge control computation unit 72 presented the head driving circuit 60 with a discharge signal for discharging droplets based on theoretical position data and arrangement data. When the theoretical position data includes a sequence of data that are not discharging positions, the amount of data in the theoretical position data may be reduced by deleting a portion of the data that are not discharging positions. When some of the data that are not discharging positions is deleted, deletion is preferably performed so that discharge does not become continuous. Deleting the non-discharging data makes it possible to reduce the amount of time needed to perform a prescribed number of discharges.

Modified Example 4

The color filter manufacturing method that employs the discharge amount measurement method described in the aforementioned first through third embodiments is not limited to a method for manufacturing a color filter that has color filters of three colors (RGB). For example, the discharge amount measurement method may also be applied to a method for manufacturing a multicolored color filter that has additional colors besides red, green, and blue. The arrangement of the RGB color layers is also not limited to a striped system, and the present invention is also applicable to a delta system or a mosaic system. Specifically, measurement discharge data may be generated on the basis of discharge data for arranging droplets in the drawing regions A of the substrate W.

Modified Example 5

The discharge amount measurement method in the aforementioned first through third embodiments is not limited to application in the pattern formation method used when a color filter is formed. For example, in a display device that has an organic EL (electroluminescence) element, the discharge amount measurement method of the present invention may also be applied to a pattern formation method for forming the positive hole implantation layer, the light-emitting layer, and the electron implantation layer that constitute the organic EL element as a light-emitting element. A liquid that includes a material for forming each layer can thereby be discharged and applied from the nozzles of a droplet discharge head in order to form a positive hole implantation layer, a light-emitting layer, and an electron implantation layer that have the appropriate thickness. Variations in the thicknesses of the positive hole implantation layer, the light-emitting layer, and the electron implantation layer of the organic EL element can be reduced. Therefore, a substantially uniform efficiency of light emission by the light-emitting element can be obtained, and irregularity during light emission can be reduced in the display device.

Modified Example 6

The electronic instrument provided with the liquid crystal display device 1 as the electro-optical device in the aforementioned fifth embodiment is not limited to a personal computer 80. For example, the electro-optical device can be suitably used as a means of image display in an electronic book, a mobile telephone, a digital still camera, a liquid crystal television, a viewfinder-type or direct-view monitor-type videotape recorder, a car navigation device, a pager, an electronic notebook, a calculator, a word processor, a work station, a video telephone, a POS terminal, a touch panel, or another electronic instrument. In any of these cases, it is possible to provide an electronic instrument having little display irregularity.

General Interpretation of Terms

In understanding the scope of the present invention, the term "configured" as used herein to describe a component, section or part of a device includes hardware and/or software that is constructed and/or programmed to carry out the desired function. In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A discharge amount measurement method for measuring a discharge amount of a liquid discharged from at least one nozzle of a droplet discharge head, the discharge amount measurement method comprising:

discharging the liquid as a droplet from the at least one nozzle of the droplet discharge head by a number of discharges that is set to obtain a measurable quantity by driving the droplet discharge head based on measurement discharge data including a bitmap that is substantially identical to a bitmap corresponding to a drawing pattern formed by discharging the liquid from the at least one nozzle of the droplet discharge head;

measuring the discharge amount of the liquid discharged from the at least one nozzle of the droplet discharge head; and calculating an average discharge amount based on the discharge amount and the number of discharges.

2. A discharge amount measurement method for measuring a discharge amount of a liquid discharged from at least one nozzle of a droplet discharge head, the discharge amount measurement method comprising:

discharging the liquid as a droplet from the at least one nozzle of the droplet discharge head by a number of discharges that is set to obtain a measurable quantity by driving the droplet discharge head based on measurement discharge data that is substantially identical to data used when a drawing pattern is formed by discharging the liquid from the at least one nozzle of the droplet discharge head;

measuring the discharge amount of the liquid discharged from the at least one nozzle of the droplet discharge head; and calculating an average discharge amount based on the discharge amount and the number of discharges, the discharging of the liquid including discharging the liquid from a plurality of nozzles provided in the droplet discharge head, the measuring of the discharge amount of the liquid including measuring the discharge amount of the liquid discharged from the plurality of nozzles of the droplet discharge head, and the discharging of the liquid including driving the droplet discharge head based on the measurement discharge data that includes all-nozzle non-discharge information in which all of the plurality of nozzles do not discharge the liquid with the measurement discharge data being adjusted such that a portion of a continuous all-nozzle non-discharge information is deleted when the all-nozzle non-discharge information is continuous.

3. The discharge amount measurement method according to claim 1, wherein the discharging of the liquid includes discharging the liquid from a plurality of nozzles provided in the droplet discharge head, and the measuring of the discharge amount of the liquid includes measuring the discharge amount of the liquid discharged from the plurality of nozzles of the droplet discharge head.

4. The discharge amount measurement method according to claim 2, wherein the measuring of the discharge amount includes measuring a weight of the liquid discharged from the at least one nozzle of the droplet discharge head.

5. A discharge amount measurement method for measuring a discharge amount of a liquid discharged from at least one nozzle of a droplet discharge head, the discharge amount measurement method comprising:

discharging the liquid as a droplet from the at least one nozzle of the droplet discharge head by a number of discharges that is set to obtain a measurable quantity by driving the droplet discharge head based on measurement discharge data that is substantially identical to data used when a drawing pattern is formed by discharging the liquid from the at least one nozzle of the droplet discharge head;

measuring the discharge amount of the liquid discharged from the at least one nozzle of the droplet discharge head; and calculating an average discharge amount based on the discharge amount and the number of discharges, the discharging of the liquid including discharging the liquid from a plurality of nozzles provided in the droplet discharge head, the measuring of the discharge amount of the liquid including measuring the discharge amount of the liquid discharged from the plurality of nozzles of the droplet discharge head, and the discharging of the liquid includes driving the droplet discharge head based on the measurement discharge data including first measurement discharge data that has information about continuously non-discharging nozzles among the plurality of nozzles, and second measurement discharge data that has information about nozzles that change from non-discharging nozzles to nozzles that continuously discharge liquid, and the discharging of the liquid includes driving the droplet discharge head using at least the first measurement discharge data and the second measurement discharge data by the number of discharges that is set to obtain the measurable quantity.

6. The discharge amount measurement method according to claim 5, wherein the discharging of the liquid includes discharging the liquid from the plurality of nozzles that are formed into at least two nozzle rows in the droplet discharge head, and the discharging of the liquid further includes driving the droplet discharge head using the first measurement discharge data and the second measurement discharge data for each of the at least two nozzle rows.

7. The discharge amount measurement method according to claim 5, wherein the measuring of the discharge amount includes measuring a weight of the liquid discharged from the at least one nozzle of the droplet discharge head.

* * * * *